US008614617B2

(12) United States Patent
Mitani et al.

(10) Patent No.: US 8,614,617 B2
(45) Date of Patent: Dec. 24, 2013

(54) REACTOR

(75) Inventors: Hiroyuki Mitani, Kobe (JP); Kyoji Zaitsu, Kobe (JP); Kenichi Inoue, Kobe (JP); Osamu Ozaki, Kobe (JP); Hiroshi Hashimoto, Kobe (JP); Hirofumi Hojo, Kobe (JP); Koji Inoue, Kobe (JP); Eiichiro Yoshikawa, Kobe (JP); Naoya Fujiwara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 204 days.

(21) Appl. No.: 13/381,679

(22) PCT Filed: Jul. 16, 2010

(86) PCT No.: PCT/JP2010/062114

§ 371 (c)(1),
(2), (4) Date: Dec. 30, 2011

(87) PCT Pub. No.: WO2011/007879

PCT Pub. Date: Jan. 20, 2011

(65) Prior Publication Data

US 2012/0105190 A1 May 3, 2012

(30) Foreign Application Priority Data

Jul. 16, 2009 (JP) ..... 2009-167789
Sep. 14, 2009 (JP) ..... 2009-211742
May 13, 2010 (JP) ..... 2010-110793

(51) Int. Cl.
*H01F 17/04* (2006.01)
*H01F 27/24* (2006.01)

(52) U.S. Cl.
USPC ..... 336/221; 336/212; 336/233

(58) Field of Classification Search
USPC ..... 336/212, 221, 233
See application file for complete search history.

(56) References Cited

U.S. PATENT DOCUMENTS 3,555,670 A * 1/1971 Zickar et al. ..... 29/605
5,315,982 A * 5/1994 Ward et al. ..... 123/634
2002/0067237 A1* 6/2002 Nakata et al. ..... 336/212

FOREIGN PATENT DOCUMENTS

CN 1206491 A 1/1999
JP 50 27949 3/1975

(Continued)

OTHER PUBLICATIONS

International Search Report issued Aug. 17, 2010 in PCT/JP2010/062114.

(Continued)

*Primary Examiner* — Tsz Chan
(74) *Attorney, Agent, or Firm* — Oblon, Spivak, McClelland, Maier & Neustadt, L.L.P.

(57) ABSTRACT

Provided is a reactor that enables high inductance to be generated with stability in a wide current range, while minimizing noise, processing cost, and eddy-current loss. The reactor (D1) has the ratio (t/W) of the width (W) to the thickness (t) of a conductive member that composes an air-core coil configured to be 1 or less, and preferably, 1/10 or less. Furthermore, the reactor also has the absolute value of a value ((L1−L2)/L3) that has had: the difference (L1−L2) between; the space interval (L1) between an inner wall face of a first core member (3) and an inner wall face of a second core member (4), at the innermost circumference position of the air-core coil (1); and the space (L2) between the inner wall face of the first core member (3) and the inner wall face of the second core member (4), at the outermost circumference position of the air-core coil (1); divided by an average value (L3); configured to be 1/50 or less. The ratio (R/W) of the radius (R), from the axis-center (O) of the air-core coil (1) to the outer circumference of the air-core coil (1), to the width (W) of the air-core coil (1) (conductive member), is 2=R/W=4.

11 Claims, 41 Drawing Sheets

(56) References Cited

FOREIGN PATENT DOCUMENTS

| | | |
|---|---|---|
| JP | 51 42956 | 4/1976 |
| JP | 55 133509 | 10/1980 |
| JP | 60 158616 | 10/1985 |
| JP | 60-158616 U | 10/1985 |
| JP | 60 210817 | 10/1985 |
| JP | 63-24816 U | 2/1988 |
| JP | 5 34090 | 2/1993 |
| JP | 5 34090 | 8/1993 |
| JP | 6 26222 | 4/1994 |
| JP | 6 224056 | 8/1994 |
| JP | 7 288210 | 10/1995 |
| JP | 10-125545 | 5/1998 |
| JP | 10 125545 | 5/1998 |
| JP | 11 8142 | 1/1999 |
| JP | 2001 525610 | 12/2001 |
| JP | 2006 222244 | 8/2006 |
| JP | 2007 128951 | 5/2007 |
| JP | 2007 173263 | 7/2007 |
| JP | 2008 42094 | 2/2008 |
| JP | 2009 59954 | 3/2009 |
| WO | WO 99/28931 A2 | 6/1999 |

OTHER PUBLICATIONS

International Search Report Issued Aug. 17, 2010 in PCT/JP10/62114 Filed Jul. 16, 2010.

Office Action Issued Aug. 17, 2010 in Japanese Patent Application 2010-110793 Filed May 13, 2010.

Combined Chinese Office Action and Search Report issued Jan. 4, 2013, in Chinese Patent Application No. 201080029639.2 with English translation and English translation of category of cited documents.

Korean Notice of Preliminary Rejection issued Feb. 14, 2013, in Korean Patent Application No. 10-2012-7001087 (with English translation).

* cited by examiner

10

S1
10
1

3
3b
1
10
4b
4

3
4
2
D1

R/W=10

R/W=5

R/W=3.3

R/W=2.5

R/W=2

R/W=1.7

R/W=1.4

R/W=1.3

10
50
H
3
1
U
4
2
D1

| | THICKNESS (μm) | DIELECTRIC STRENGTH VOLTAGE (2.0kV) |
|---|---|---|
| KAPTON SHEET (POLYIMIDE) | 25 | × |
| | 50 | × |
| | 250 | ○ |
| PEN SHEET | 75 | × |
| | 125 | ○ |
| PPS | 100 | ○ |
| NOMEX | 100 | ○ |

REACTOR

TECHNICAL FIELD

The present invention relates to a reactor that is suitably utilized in electrical circuits, electronic circuits, and the like, for example.

BACKGROUND ART

Reactors that are passive elements employing windings are used in various electric circuits and electronic circuits such as for the prevention of harmonic current in a power factor improvement circuit, the smoothing of current pulsation in a current source inverter and chopper control, and the step-up of direct current voltage in a converter. There are Patent Literature 1 to Patent Literature 4 as technical literature related to this type of reactor, for example.

Patent Literature 1 discloses a reactor including a coil, a core composed of a magnetic powder mixed resin that is packed inside and at the outer circumference of the coil, and a case that accommodates the coil and core, further including protrusions formed on an inner wall face of the case.

Patent Literature 2 discloses a reactor including: a pair of soft magnetic alloy pressurized powder cores of rod shape, each core being inserted into a thorough hole of a bobbin around which a coil is wound so that the core serves as an axis, around which the coil is wound and fixed; and a pair of plate-like soft ferrite cores connected with ends of the pair of soft magnetic alloy pressurized powder cores, respectively, to form a quadrangular composite core along with the pair of soft magnetic alloy pressurized powder cores. This reactor disclosed in Patent Literature 2 has an object of a size reduction and lowering loss, and a gap is provided at opposing portions of the soft magnet alloy pressurized powder core and the soft ferrite core so as to achieve an inductance of about 2 mH during OA.

However, in a case of such a gap being provided in a core member, problems in noise and magnetic flux leakage generally arise. In addition, the dimensional precision of the gap provided to the core member influences the inductance characteristic of the reactor; therefore, disadvantages also arise in that it is necessary to precisely form the gap, and manufacturing cost of the reactor increases. Employing a ceramic material may be included in the gap portion as noise control; however, there is a problem in that the manufacturing cost of the reactor increases also due to such noise control.

On the other hand, reactors employing air-core type coils are proposed in Patent Literature 3 and Patent Literature 4. Patent Literature 3 discloses an air-core reactor in which each coil turn is configured by overlapping a plurality of band-like unit conductors over each other. In this reactor, the thickness of coil turns in the radial direction of the reactor is less than the width in the axial direction thereof.

In addition, Patent Literature 4 discloses a reactor made by a plurality of disc windings wound around the circumference of an insulating cylinder and stacked in multiple steps in the winding axis direction, and each disc winding being connected to each other, in a state surrounded by a magnetic shielding iron core.

CITATION LIST

Patent Literature

[PATENT LITERATURE 1] Japanese Patent Application Publication No. 2008-42094

[PATENT LITERATURE 2] Japanese Patent Application Publication No. 2007-128951

[PATENT LITERATURE 3] Japanese Patent Application Publication No. S50-27949

[PATENT LITERATURE 4] Japanese Patent Application Publication No. S51-42956

SUMMARY OF INVENTION

Technical Problem

The air-core type reactors described in Patent Literature 3 and Patent Literature 4 have structures that are not complicated like that of Patent Literature 2, and obtain stable inductance characteristics in a relatively wide current range.

However, with simple air-core type reactors, the inductance lowers, and thus the desired characteristics are difficult to obtain. In addition, depending on the coil shape and the like, there is also a problem in that the eddy current loss rises.

The present invention has been made in order to solve the aforementioned problems, and has an object of providing a reactor from which high inductance is obtained stably over a wide current range, while suppressing noise, manufacturing cost and eddy current loss.

Solution to Problem

As a result of thorough research, the present inventors have found that the above-mentioned object is achieved by the present invention as follows. More specifically, a reactor according to one aspect of the present invention includes: an air-core coil formed by winding an elongated conductive member; and a core portion that covers both ends and an outer circumference of the air-core coil, in which a ratio t/W of a length t of the elongated conductive member in a radial direction of the air-core coil to a length W of the elongated conductive member in an axial direction of the air-core coil is no more than 1, in which one surface of the core portion that opposes one end of the air-core coil and one other surface of the core portion that opposes one other end of the air-core coil are parallel at least in regions covering the coil ends, in which a circumferential direction surface of the elongated conductive member forming the air-core coil is perpendicular relative to the one surface of the core portion, and in which a ratio R/W of a radius R from a center to an outer circumference of the air-core coil to a length W of the elongated conductive member in the axial direction of the air-core coil is 2 to 4. According to a reactor of such a configuration, it is possible for a high inductance to occur stably over a wide current range, while suppressing noise, manufacturing cost and eddy current loss.

In addition, according to another aspect, in the aforementioned reactor, projections protruding to the air-core coil may be formed at positions, facing an air-core part of the air-core coil, on an upper face and a lower face of the core portion, the projections may be formed so as to satisfy: $0<a\leq W/3$ and $r>\sqrt{(A^2+(W/2)^2)}$, in which r is defined as the radius of the air-core part of the air-core coil, a is defined as the height from a core surface, opposing a coil end, of the projection, and A is defined as the radius of a projection bottom surface. According to this configuration, it is possible to further improve the inductance of the reactor.

Moreover, according to another aspect, in these aforementioned reactors, the ratio t/W may be no more than 1/10. Alternatively, the length t may be no more than a skin thickness relative to the drive frequency of the reactor. According to these configurations, it is possible to drastically reduce the occurrence of eddy current loss in the reactor.

Furthermore, according to another aspect, in these aforementioned reactors, an absolute value of parallelism ((L1–L2)/L3), calculated by dividing a difference (L1–L2) between a space interval L1 between one surface of the core portion and one other surface of the core portion at an inner circumferential end of the air-core coil, and a space interval L2 between one surface of the core portion and one other surface of the core portion at an outer circumferential end of the air-core coil, by an average space interval L3, may be no more than 1/50. According to this configuration, magnetic flux lines passing through the inside of the air-core coil can be made parallel to the axial direction, and the direction of the magnetic flux lines passing through inside the air-core coil and the cross section of the conductive member can be made substantially parallel. Therefore, it is possible to prevent or suppress the eddy current loss from increasing and the inductance decreasing due to the magnetic flux lines passing through the inside of the air-core coil not being parallel to the axial direction.

In addition, according to another aspect, in these aforementioned reactors, the elongated conductive member may be formed by laminating conductive layers and insulation layers in a thickness direction thereof, and the conductive layers that are adjoining each other may be joined to each other outside of the core portion such that the insulation layers are not sandwiched at an end in the longitudinal direction of the elongated conductive member. According to this configuration, the cross-sectional area, along a direction in which current flows, of the conductor is ensured, whereby an increase in the electrical resistance of the air-core coil can be suppressed.

Moreover, according to another aspect, in the aforementioned reactor, the conductive layers themselves, or lead wires led out from the respective conductive layers may pass through an inductor core provided outside of the core portion so as to be reverse phases from each other, and then may be joined to each other. According to this configuration, it is possible to effectively suppress eddy current.

Additionally, according to another aspect, in these aforementioned reactors, the air-core coil may be formed by laminating three single-layer coils, each of which is formed by winding the elongated conductive member that is insulatively covered by an insulating material, in a thickness direction, and winding starts of the three single-layer coils may be independent from each other as first terminals of current lines, and winding ends of three of the single-layer coils may be independent from each other as second terminals of the current lines. According to this configuration, the coils for the three phases can be accommodated in a space for one coil; therefore, it is possible to make the physical size smaller compared to a conventional type of three-phase reactor of the same power capacity.

Furthermore, according to another aspect, these aforementioned reactors may further include an insulation member that is disposed at least between one end of the air-core coil and one surface of the core portion opposing the one end, and between one other end of the air-core coil and one other surface of the core portion opposing the one other end. According to this configuration, it is possible to further improve the dielectric strength between the air-core coil and the core portion.

In addition, according to another aspect, in these aforementioned reactors, the core portion may include a plurality of core members, the reactor may further include: a fixing member that fixes the core portion to a mounting member that mounts the core portion; and a fastening member that fastens the plurality of core members to form the core portion by the plurality of core members, in which a first arrangement position of the fixing member and a second arrangement position of the fastening member in the core portion may be different from each other. According to this configuration, since the arrangement positions of the fixing members and the arrangement positions of the fastening members are provided separately, the plurality of core members is firstly fastened by the fastening members, and then the core portion configured in this way can be fixed to the mounting member by the fixing members. As a result, the productivity of assembling and installing reactors can be improved.

Moreover, according to another aspect, in these aforementioned reactors, the core portion may have magnetic isotropy and be formed by forming a soft magnetic powder. Alternatively, the core portion may be a ferrite core having magnetic isotropy. According to these configurations, the desired magnetic property can be obtained relatively easily for the core portion, and the core portion can be relatively easily formed into a desired shape.

Advantageous Effects of Invention

According to the present invention, it is possible to realize a reactor in which high inductance generates stably over a wide current range, while suppressing noise, manufacturing cost and eddy current loss.

DESCRIPTION OF EMBODIMENTS

Hereinafter, embodiments according to the present invention will be explained based on the drawings. It should be noted that the configurations to which the same symbol is assigned in each of the drawings indicate the same configuration, and explanations thereof will be omitted as appropriate.

Figure 1:
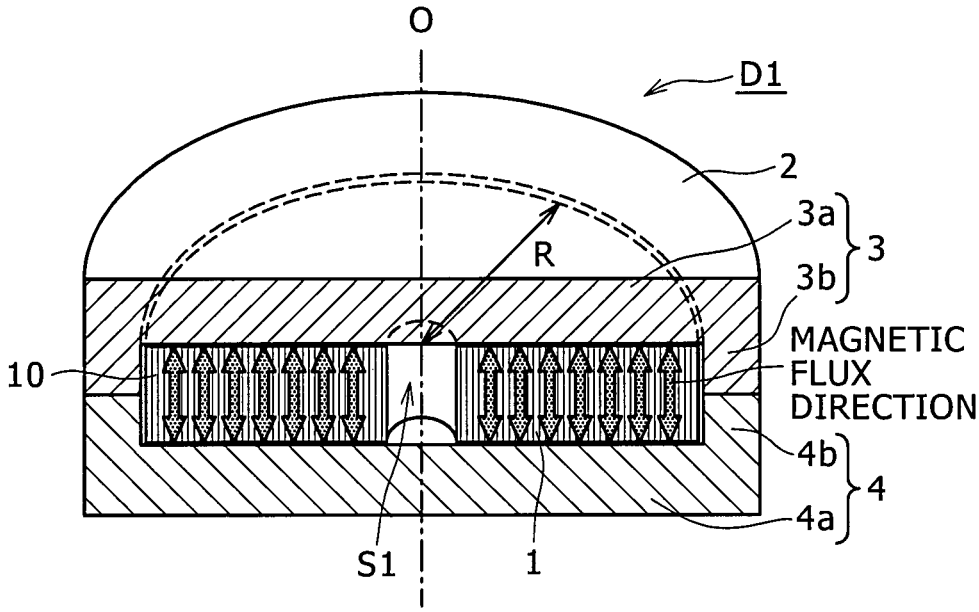
FIG. 1 is a view showing a first embodiment of a reactor according to the present invention.
Figure 2:
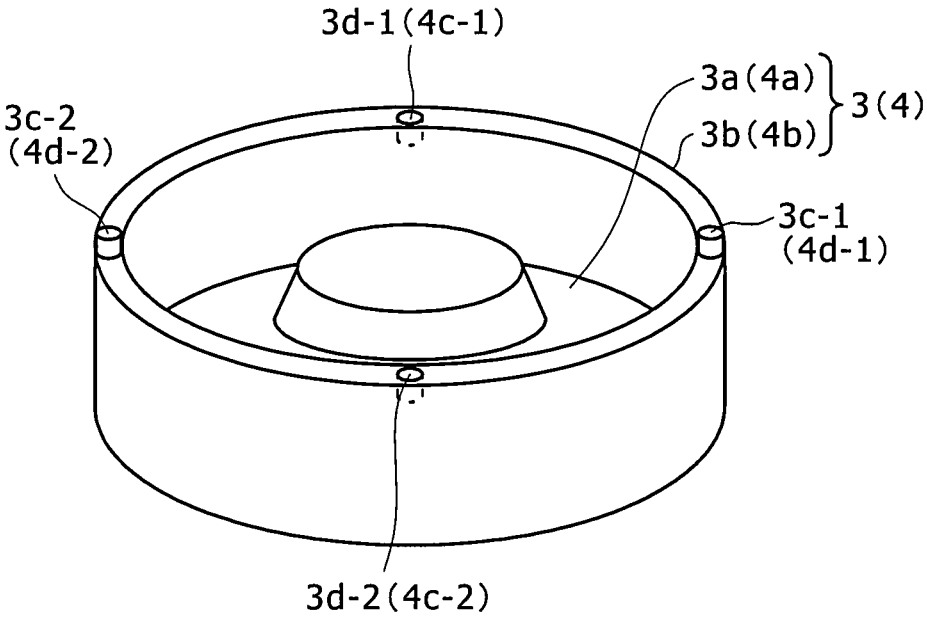
FIG. 2 is a perspective view showing another form of a core member in the reactor according to the first embodiment.

Hereinafter, an embodiment of a reactor according to the present invention will be explained. FIG. 1 shows a first embodiment of a reactor according to the present invention, and is a cross-sectional view sectioned in a plane including an axis-center O. FIG. 2 is a perspective view showing another form of a core member in the reactor of the first embodiment.

As shown in FIG. 1, a reactor D1 includes an air-core coil 1 having a flat-wise winding structure described later, and a core portion 2 that covers the air-core coil 1. It should be noted that an explanation will be made from the core portion 2 for convenience of explanation.

The core portion 2 includes first and second core members 3 and 4, which have magnetic (e.g., magnetic permeability) isotropy together with having identical configurations. The first and second core members 3 and 4 are respectively configured so as to have cylindrical parts 3*b* and 4*b*, which have an outer circumferential surface of the same diameter as disc parts 3*a* and 4*a* having a disc shape, for example, and which are continuous from disc parts 3*a* and 4*a*. A core portion 2 is provided with a space for accommodating the air-core coil 1 inside by the first and second core members 3 and 4 being superimposed with each other along the end faces of the respective cylindrical parts 3*b* and 4*b*.

It should be noted that, at each end face of the cylindrical parts 3*b* and 4*b* of the first and second core members 3 and 4, convex parts 3*c* and 4*c* for positioning may be provided, and concave parts 3*d* and 4*d* may be provided to accept these convex parts 3*c* and 4*c*. For example, as shown in FIG. 2, first and second convex parts 3*c*-1, 3*c*-2; 4*c*-1, 4*c*-2 of substantially columnar shape are provided at 180° intervals (positions opposing each other) at the end faces of the cylindrical parts 3*b* and 4*b* of the first and second core members 3 and 4, respectively. In addition, first and second concave parts 3*d*-1, 3*d*-2; 4*d*-1, 4*d*-2 of substantially columnar shape such that the first and second convex parts 3*c*-1, 3*c*-2; 4*c*-1, 4*c*-2 are caught therein are provided at 180° intervals (positions opposing each other) at the end faces of the cylindrical parts 3*b* and 4*b* of the first and second core members 3 and 4. Then, these first and second convex parts 3*c*-1, 3*c*-2; 4*c*-1, 4*c*-2 as well as the first and second concave parts 3*d*-1, 3*d*-2; 4*d*-1, 4*d*-2 are provided at 90° intervals, respectively. It should be noted that, in the example of FIGS. 1 and 2, the first and second core members 3 and 4 have the same shape, with one of the first and second core members 3 and 4 including a projection described later being shown in FIG. 2. By providing such convex parts 3*c* and 4*c* and concave parts 3*d* and 4*d* for positioning at the end faces of the cylindrical parts 3*b* and 4*d*, respectively, it is possible to more reliably make the first and second core members 3 and 4 match faces.

The first and second core members 3 and 4 have a predetermined magnetic property. In order to reduce cost, the first and second core members 3 and 4 are preferably made of the same material. Herein, it is preferable for the first and second core members 3 and 4 to be formed by forming a powder of a soft magnetic substance in order to easily realize the desired magnetic property (relatively high magnetic permeability), and in order to facilitate the forming into the desired shape.

This soft magnetic powder is a ferromagnetic metal powder, and more specifically, can be exemplified by a pure iron powder, an iron-based alloy powder (such as Fe—Al alloy, Fe—Si alloy, sendust and permalloy) and amorphous powder, and further, an iron powder for which an electrically insulating film such as a phosphate-based chemical conversion coating film is formed on the surface thereof, and the like. These soft magnetic powders are producible by an atomizing method or the like, for example. In addition, the soft magnetic powder is preferably a metallic material such as the above-mentioned pure iron powder, iron base alloy powder and amorphous powder, for example, since the saturation magnetic flux density is generally high in the case of the magnetic permeability being equal.

Figure 3:
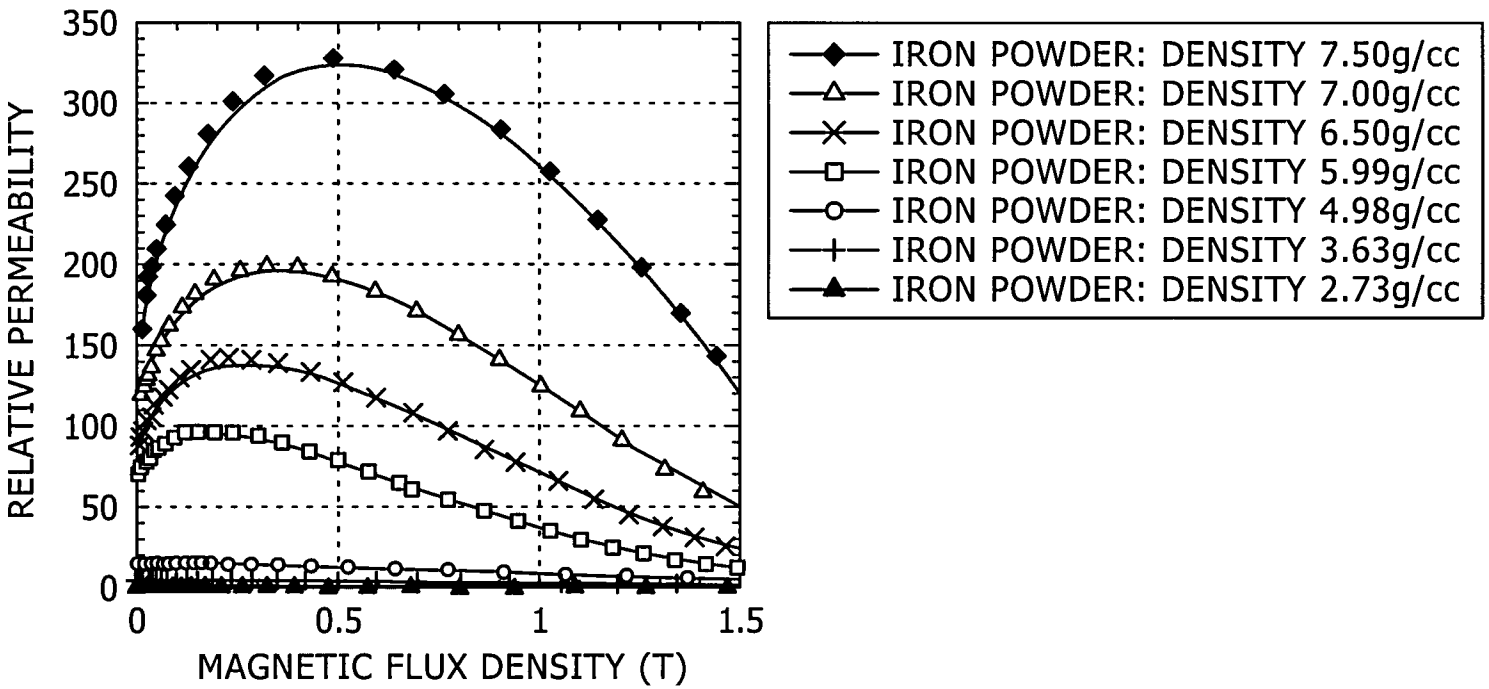
FIG. 3 is a graph showing the magnetic flux density-relative permeability characteristic for different densities of magnetic substances containing iron powder.

Such first and second core members 3 and 4 are members of a predetermined density, obtained by compaction-forming a soft magnetic powder by means of a well-known common means, for example. This member has the magnetic flux density-relative permeability characteristic shown in FIG. 3, for example. FIG. 3 is a graph showing the magnetic flux density-relative permeability characteristic for different densities of magnetic substances containing iron powder. The horizontal axis in FIG. 3 indicates the magnetic flux density (T), and the vertical axis indicates the relative permeability.

As shown in FIG. 3, in the profile of the magnetic flux density-relative permeability characteristic related to a members with a density of at least 6.00 g/cc (in this example, density of 5.99 g/cc (□), density of 6.50 g/cc (×), density of 7.00 g/cc (Δ), and density of 7.50 g/cc (♦)), according as the magnetic flux density increases, the relative permeability starts from the initial relative permeability, which is relatively high, reaches a peak (maximum value), and gradually decreases thereafter.

For example, in the profile of the magnetic flux density-relative permeability characteristic related to the member having a density of 7.00 g/cc, according as magnetic flux density increases until it reaches 0.35 T, the relative permeability starts from the initial relative permeability of about 120, suddenly increases until about 200, and subsequently gradually decreases. In the example show in FIG. 3 (density of 7.00 g/cc), the magnetic flux density at which the relative permeability, which is after the increase from the initial relative permeability according as the magnetic flux density increases, reaches again the initial relative permeability is about 1 T.

In addition, the initial relative permeabilities of the member having a density of 5.99 g/cc, the member having a density of 6.50 g/cc, and the member having a density of 7.50 g/cc are about 70, about 90, and about 160, respectively. A material having such an initial relative permeability of about 50 to 250 (in this example, materials of about 70 to about 160), having profiles of magnetic flux density-relative permeability characteristic that are substantially the same, are materials having relatively high relative permeabilities.

Referring back to FIG. 1, an air-core part S1 of columnar shape having a predetermined diameter at the center (on an axis-center O) is provided to the air-core coil 1. The air-core coil 1 is formed by winding a ribbon-shaped conductive member 10, having a predetermined thickness, a predetermined number of times, and leaving the air-core part S1, such that the width direction of the ribbon-shaped conductive member 10 substantially matches with the axis-center direction. The air-core coil 1 is installed in the internal space of the core portion 2 (space formed by the inner wall faces of the first and second core members 3 and 4).

Figures 4A, 4B, 4C, 4D:
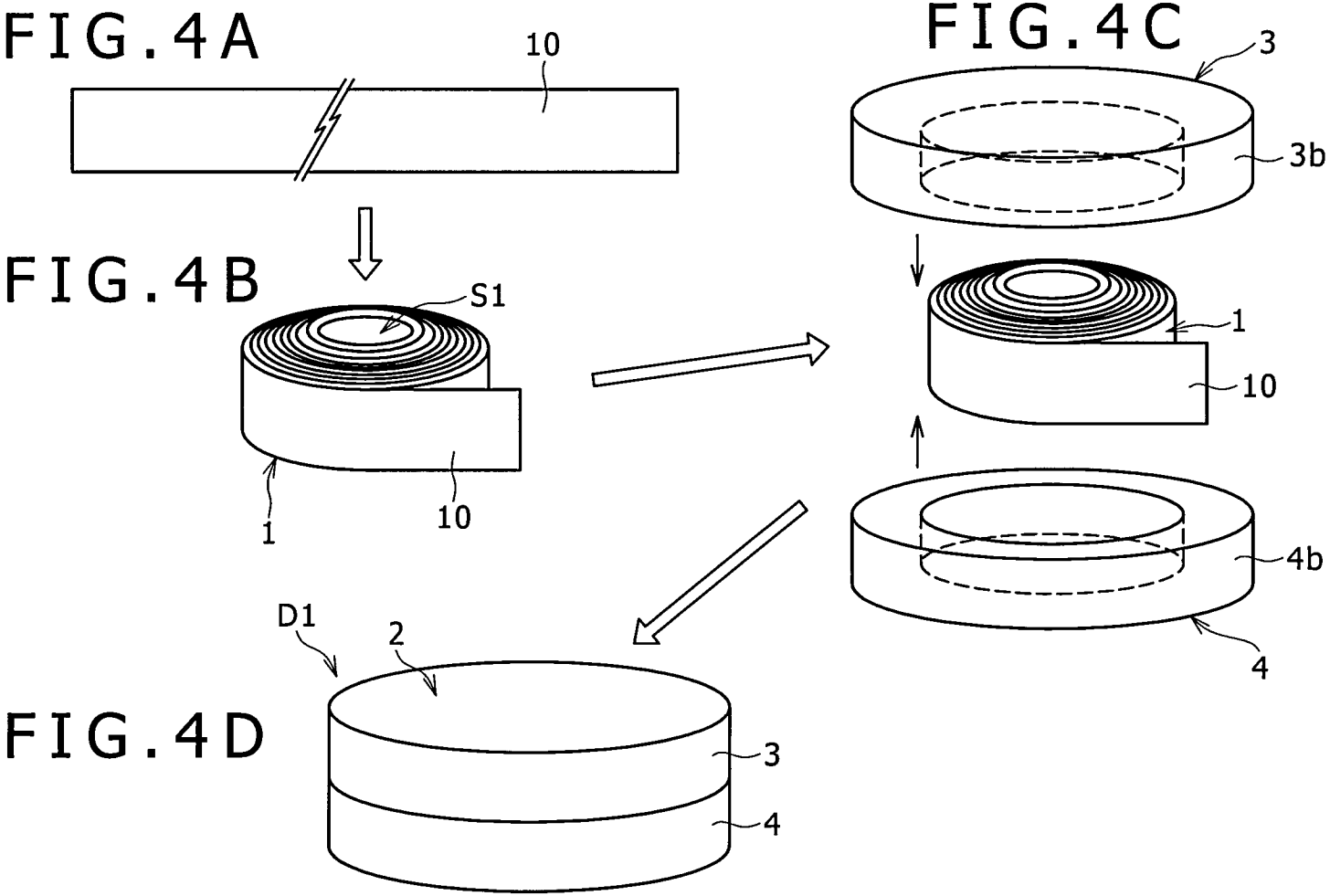
FIGS. 4(*a*), (*b*), (*c*) and (*d*) are diagrams for illustrating the manufacturing process of a reactor according to the first embodiment.
Figure 5A:
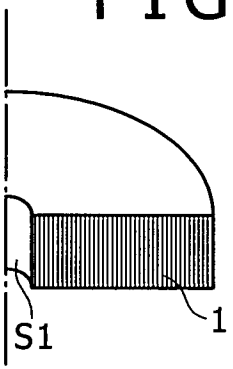
FIG. 5 is an illustration showing the relationship between the configuration and magnetic flux lines of the reactor, with (a) being a configurational view of a reactor having an air-core coil externally exposed (Comparative Example 1), (b) being a configurational view of a reactor according to the present embodiment, (c) being a configurational view of a reactor in which an air-core coil is covered by a core portion and an air-core portion includes a magnetic substance (Comparative Example 2), (d) being a magnetic flux line illustration for the reactor according to Comparative Example 1, (e) being a magnetic flux line illustration for the reactor according to the present embodiment, and (f) being a magnetic flux line illustration for the reactor according to Comparative Example 2.
Figure 5B:
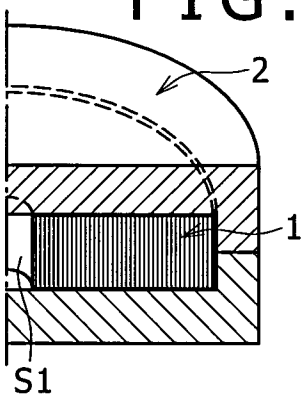
Figure 5C:
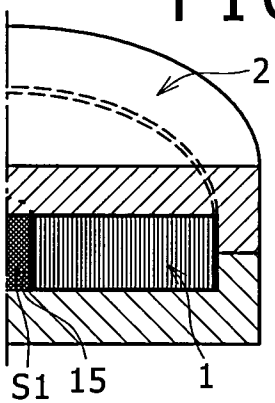
Figure 5D:
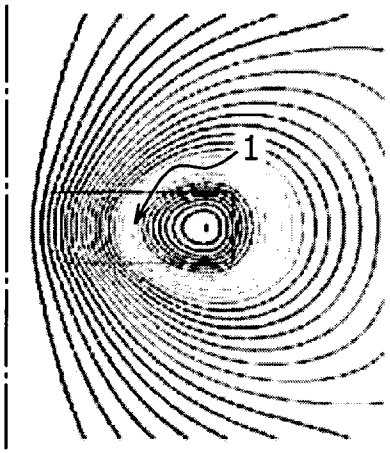
Figure 5E:
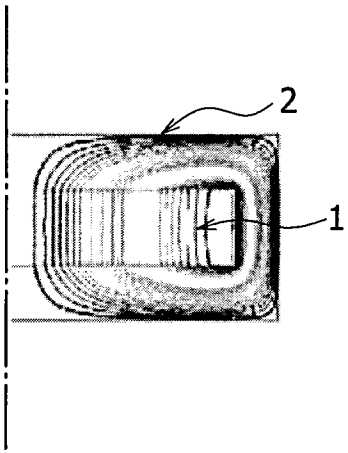
Figure 5F:
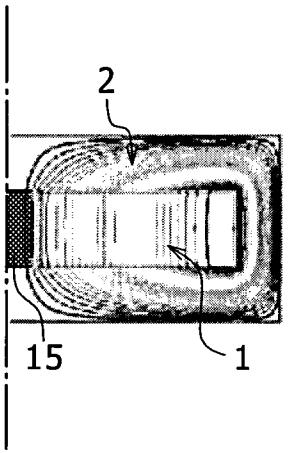

The reactor D1 of such a configuration can be manufactured by the following process, for example. FIGS. 4(*a*) to (*d*) are diagrams for illustrating the manufacturing process of a reactor according to the first embodiment.

First, the ribbon-shaped conductive member 10 having a predetermined thickness shown in FIG. 4(*a*) is wound a predetermined number of times from a position separated by a predetermined radius from the center (axis-center), as shown in FIG. 4(*b*). The air-core coil 1 of a pancake structure including the air-core part S1 of columnar shape having a predetermined radius at the center is thereby formed.

Next, as shown in FIG. 4(*c*), the first and second core members 3 and 4 are made to overlap along the end faces of the cylindrical parts 3*b* and 4*b*, so as to sandwich the air-core coil 1 therebetween. The disc-shaped reactor D1 such as that shown in FIG. 4(*d*) is thereby created.

The reactor D1 having such a configuration has the following advantages compared to a reactor in which a core portion 2 is not provided and the air-core coil 1 is externally exposed (referred to as Comparative Example 1), and a reactor in which the air-core coil 1 is covered by the core portion 2 and including a magnetic body 15 at the axis-center O (air-core part S1 shown in FIGS. 1 and 4) (referred to as Comparative Example 2).

FIGS. 5(*a*) to (*f*) are illustrations showing the relationship between the configuration of the reactor and magnetic flux lines. FIG. 5(*a*) is a cross-sectional view showing the configuration of the reactor according to Comparative Example 1; FIG. 5(*b*) is a cross-sectional view showing the configuration of the reactor D1 according to the present embodiment; and FIG. 5(*c*) is a cross-sectional view showing the configuration of the reactor according to Comparative Example 2. In addition, FIG. 5(*d*) is a magnetic flux line illustration for the reactor according to Comparative Example 1; FIG. 5(*e*) is a magnetic flux line illustration for the reactor D1 according to the present embodiment; and FIG. 5(*f*) is a magnetic flux line illustration for the reactor according to Comparative Example 2. It should be noted that, in FIGS. 5(*d*) to (*f*), an indication for the boundary line between adjacent windings is omitted in consideration of the visibility of the drawings.

Figure 6:
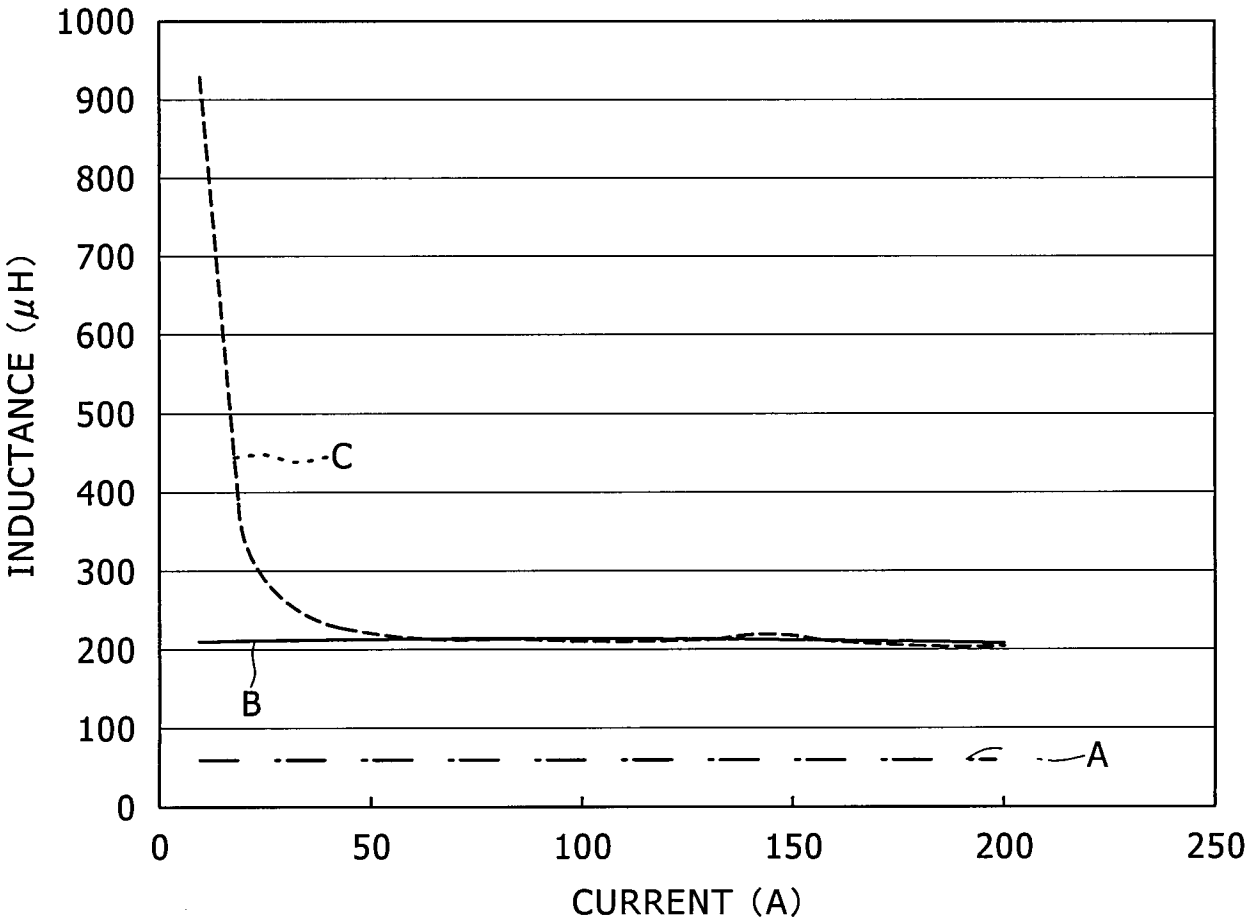
FIG. 6 is a graph showing experimental results for the change in inductance when the current is varied in the range of 0 to 200 (A) for the reactors according to the present embodiment and Comparative Examples 1 and 2.

In addition, FIG. 6 shows experimental results for the change in inductance when causing the current to vary in the range of 0 to 200 (A) for the reactors according to the present embodiment and Comparative Examples 1 and 2. In FIG. 6, graph A shows the change in inductance of the reactor according to Comparative Example 1, graph B shows the change in inductance of the reactor D1 according to the present embodiment, and graph C shows the change in inductance of the reactor according to Comparative Example 2.

Referring to graph A of FIG. 6, a substantially constant inductance is stably obtained in the entire range of current for the reactor according to Comparative Example 1. However, since, with this reactor, the magnetic flux lines at the inside of the air-core coil are not parallel to the axial direction, as shown in FIG. 5(*d*), the eddy current loss becomes great. As a result, the inductance is absolutely small as shown in graph A of FIG. 6. In addition, the magnetic flux lines leaking out from the reactor to outside are extremely abundant, as shown in FIG. 5(*d*).

As shown in graph C of FIG. 6, in the reactor according to Comparative Example 2, a high inductance is obtained in a relatively small range of current of 0 (A) to about 30 (A). In addition, since this reactor has the core portion 2, the magnetic flux lines can be prevented or suppressed from leaking out from the reactor to outside. However, in the reactor according to Comparative Example 2, when the current becomes larger than this range, the magnetic body 15 is magnetically saturated, and the inductance suddenly declines. When the change in inductance is great in this way, the inductance characteristic will change relatively greatly with a slight error; therefore, the controllability of an inverter equipped with the reactor becomes poor.

In contrast to this, in the reactor D1 according to the present embodiment, the magnetic flux lines can be prevented or suppressed from leaking out from the reactor D1 to outside to the extent equivalent to the reactor according to Comparative Example 2, due to the existence of the core portion 2 similarly to Comparative Example 2. In addition, as shown in graph B of FIG. 6, the reactor D1 has the advantages of a stable inductance characteristic being obtained in the entire range of current, and the inductance thereof being high relative to Comparative Example 1.

Figure 7:
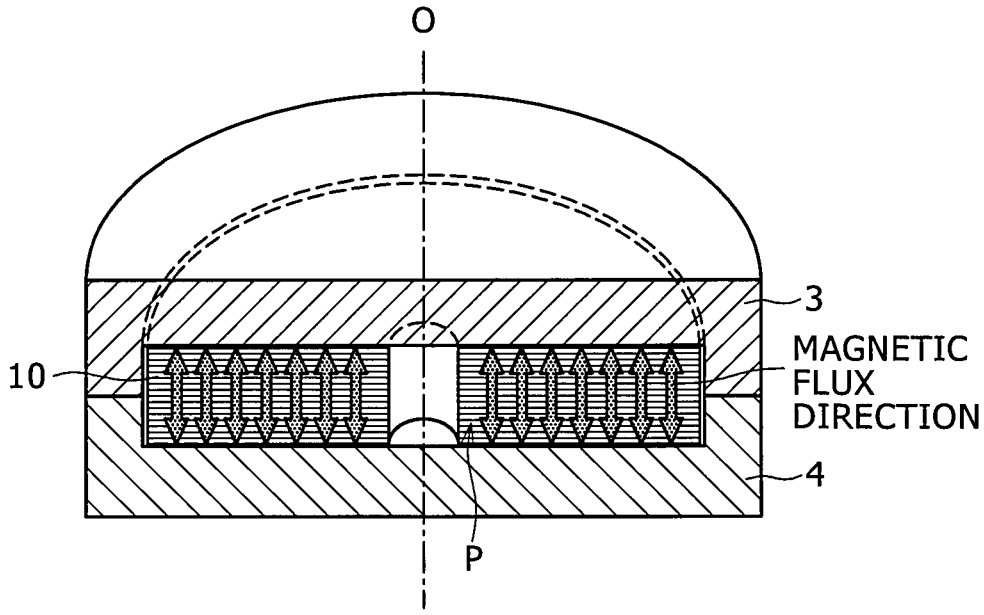
FIG. 7 is a cross-sectional view showing an edge-wise winding structure.
Figure 8:
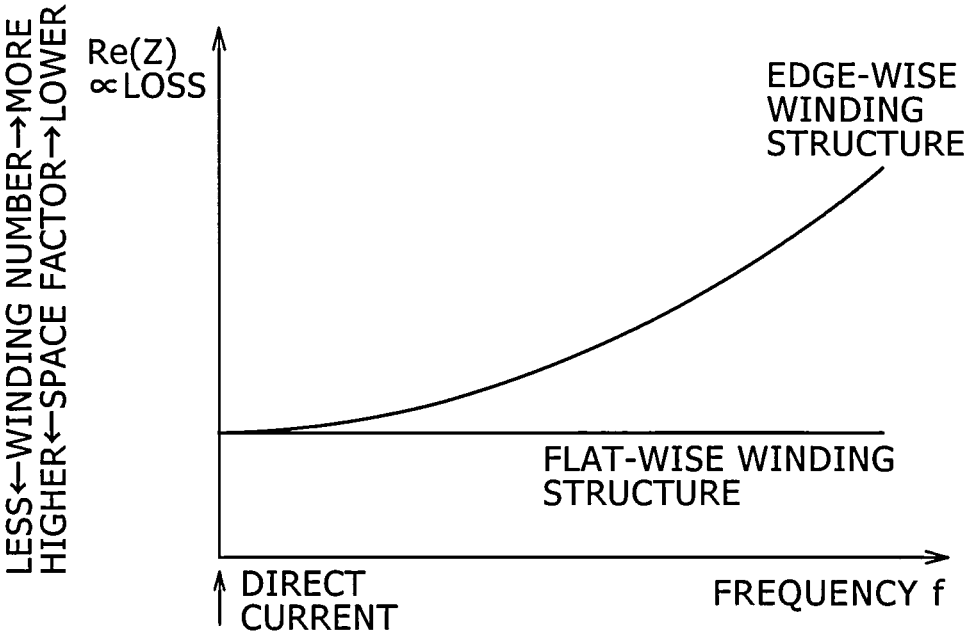
FIG. 8 is a view showing the relationship between the frequency f and loss of a reactor for different winding structures of coils (flat-wise winding structure and edge-wise winding structure)
Figure 9A:
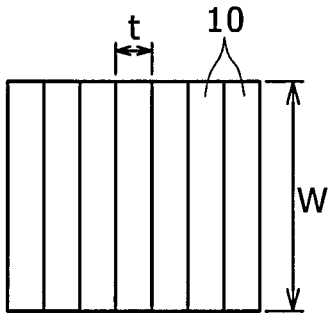
FIG. 9 is a view showing the cross-sectional shapes of the conductive member and the coil, with (a) being a view showing a coil configured by a conductive member having a rectangular cross section with a width W of no more than thickness t, and (b) being a view showing a coil configured by a conductive members having a rectangular cross section with a width W longer than the thickness t.
Figure 9B:
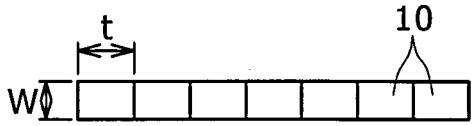

Next, advantages will be mentioned for the reactor D1 having a flat-wise winding structure in which a conductive member 10 is wound so as to overlap in the radial direction, as in the present embodiment. FIG. 7 is a cross-sectional view showing an edge-wise winding structure in which a conductive member is wound so as to overlap in the radial direction. FIG. 8 is a graph showing the relationship between frequency f and loss of a reactor in different winding structures (flat-wise winding structure and edge-wise winding structure), with the horizontal axis indicating the frequency f, and the vertical axis indicating the loss. FIG. 9 is a view showing the cross-sectional shapes of the conductive member 10 and the coil.

Since the air-core coil is configured from conductors, when electric current passes through the air-core coil, eddy current generally generates in the surface perpendicular to the magnetic field line (orthogonal plane), and loss occurs due to this. In a case of the magnetic flux density being uniform, the magnitude of this eddy current is proportional to the area intersecting with the magnetic field line, i.e. area of the continuous surface perpendicular to the magnetic flux direction. Since the magnetic flux direction at the inside of the air-core coil follows the axial direction, the eddy current is proportional to the area of the surface, in the radial direction orthogonal to the axial direction, of the conductor configuring the air-core coil.

As a result, with the edge-wise winding structure, the area in the radial direction of the conductive member 10 is large as shown in FIG. 7, and tends to produce eddy current; therefore, the loss occurring due to eddy current becomes more dominant than the loss occurring due to electrical resistance. Consequently, with the edge-wise winding structure, the loss depends on the frequency of the electrical current passing therethrough, the loss increases accompanying an increase in the frequency, and thus the initial loss due to the relatively low electrical resistance becomes relatively small, as shown in FIG. 8.

On the other hand, as shown in FIG. 1, in the flat-wise winding structure employed in the reactor D1 according to the present embodiment, the area in the radial direction of the conductive member 10 is small, and thus eddy current does not easily arise; whereas, the area in the axial direction of the conductive member 10 is large. Therefore, in the flat-wise winding structure, almost no eddy current occurs, the loss is substantially constant irrespective of the frequency of the electrical current passing therethrough, and the initial loss due to the relatively low electrical resistance becomes relatively small, as shown in FIG. 8.

Furthermore, as shown by the arrow P in FIG. 7, the conductive member 10 is overlapped in the axial direction in the edge-wise winding structure. In contrast, in the flat-wise winding structure shown in FIG. 1, the width direction of the conductive member 10 is substantially consistent with and continuous in the axial direction; therefore, heat conduction can be carried out more effectively than the edge-wise winding structure. Consequently, the flat-wise winding structure is more superior to the edge-wise winding structure in the points of loss and heat conduction.

Furthermore, in the flat-wise winding structure in the present embodiment, the width W of the conductive member 10 configuring the air-core coil 1 is equal to or more than the length (hereinafter referred to as thickness) t in the radial direction of the conductive member 10, as shown in FIG. 9(*a*). In other words, in the present embodiment, the reactor is configured by a conductive member having a rectangular cross-section such that a ratio of the thickness t of the conductive member 10 to the width W of the conductive member 10 (t/W) is no more than 1.

The area in the radial direction of the conductive member 10 in the reactor of the present embodiment thereby becomes small relative to a reactor configured by the conductive member 10 having a rectangular cross-section such that the thickness t of the conductive member 10 is longer than the width W of the conductive member 10, as shown in FIG. 9(*b*). As a result thereof, the flat-wise winding structure can reduce the eddy current loss for the same reason as the reason that the flat-wise winding structure is more superior to the edge-wise winding structure in the point of loss. In particular, when the ratio (t/W) of the width W to the thickness t of the conductive member 10 is no more than 1/10, it is possible to drastically reduce the occurrence of eddy current loss.

Furthermore, it is necessary for the inner wall face of the first core member 3 (hereinafter referred to as upper wall surface) and the inner wall face of the second core member 4 (hereinafter referred to as lower wall surface), which respectively oppose both top and bottom end faces of the air-core coil 1, to be parallel at least in a region covering the coil ends. In addition, it is necessary for this upper wall surface and lower wall surface to be perpendicular with the surface of the air-core coil 1 in the circumferential direction of conductive member 10. In a case of these conditions not being met, the magnetic flux lines passing through the inside of the air-core coil 1 will not be parallel to the axial direction, even if the condition relating to the cross-sectional shape of the conductive member 10 is established. Therefore, in the present embodiment, parallelism such that the upper wall surface of the first core member 3 and the lower wall surface of the second core member 4 appear parallel is established, as explained in the following.

Figure 10:
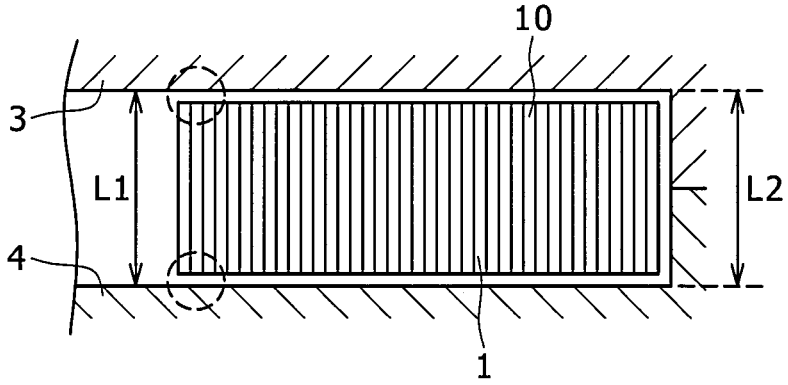
FIG. 10 is an explanatory illustration of a calculation method for parallelism.

FIG. 10 is an explanatory illustration of a calculation method for parallelism. As shown in FIG. 10, among the spaces between the upper wall surface of the first core member 3 and the lower wall surface of the second core member 4, the space at the position on a most inner circumferential side (hereinafter referred to as innermost circumference position) is L1, and the space at the position on the most outer circumferential side (hereinafter referred to as outermost circumference position) is L2. In addition, the average value of the spaces between the upper wall surface of the first core member 3 and the lower wall surface of the second core member 4 for the positions from the innermost circumference position to the outermost circumference position is L3. It should be noted that the average value L3 is the average value of the space between the upper wall surface of the first core member 3 and the lower wall surface of the second core member 4, for the plurality of positions separated by predetermined intervals in the radial direction between the innermost circumference position and the outermost circumference position.

At this time, a value ((L1−L2)/L3) obtained by dividing the difference (L1−L2) of the space L1 between the upper wall surface of the first core member 3 and the lower wall surface of the second core member 4 at the innermost circumference position of the air-core coil 1, and the space L2 between the upper wall surface of the first core member 3 and the lower wall surface of the second core member 4 at the outermost circumference position of the air-core coil 1 by the average value L3 is established as the parallelism.

Figure 11:
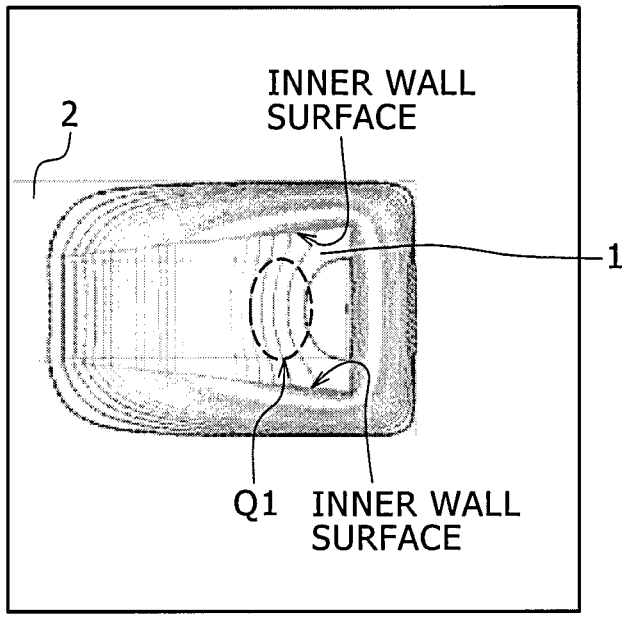
FIG. 11 is a magnetic flux illustration when the parallelism is −1/10.
Figure 12:
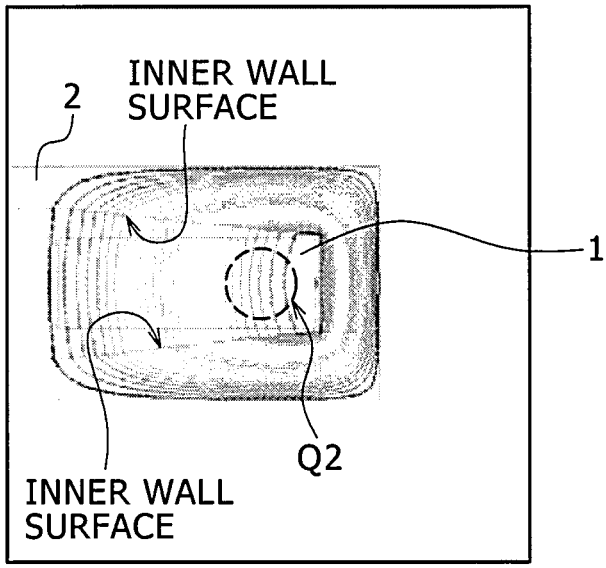
FIG. 12 is a magnetic flux illustration when the parallelism is 1/10.
Figure 13:
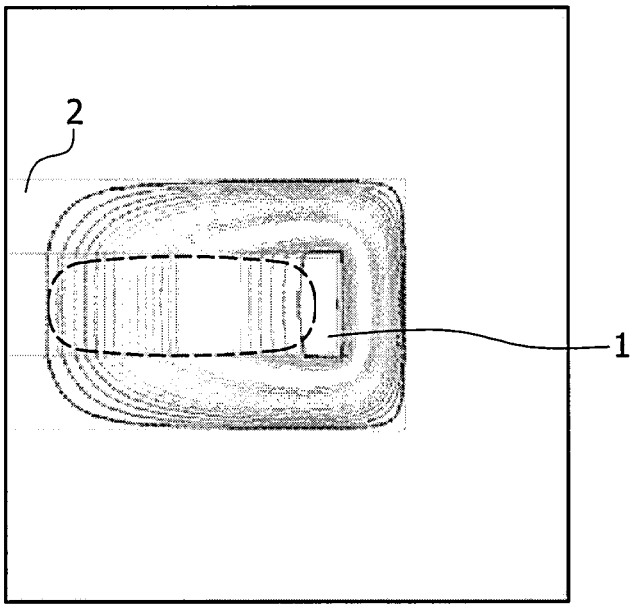
FIG. 13 is a magnetic flux illustration when the parallelism is 1/100.

FIG. 11 is a magnetic flux line illustration when the parallelism is −1/10, FIG. 12 is a magnetic flux line illustration when the parallelism is 1/10, and FIG. 13 is a magnetic flux line illustration when the parallelism is 1/100. As shown in FIG. 13, when the parallelism is 1/100, the magnetic flux lines passing through the inside of the air-core coil 1 (magnetic flux lines of the portion indicated by dotted lines) are parallel to the axial direction. On the other hand, when the parallelism is −1/10 or 1/10, the magnetic flux lines passing through the inside of the air-core coil 1 are not parallel to the axial direction, as shown by arrows Q1 and Q2 in FIGS. 11 and 12. When the magnetic flux lines passing through the inside of the air-core coil 1 are not parallel, the eddy current loss becomes great and the inductance becomes absolutely small, as explained above.

Therefore, the present inventors have verified the distribution of magnetic flux lines, while variously changing the parallelism. As a result, the present inventors learned that it is necessary to set the absolute value of parallelism to no more than 1/50 in order to make the magnetic flux lines passing through the inside of the air-core coil 1 parallel.

Figure 14:
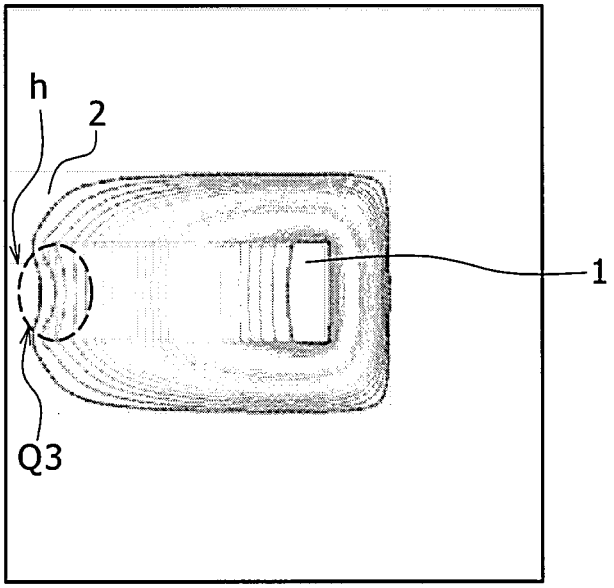
FIG. 14 is one example of a magnetic force line illustration in a case of a projection h being present on an axis-center side.
Figure 15:
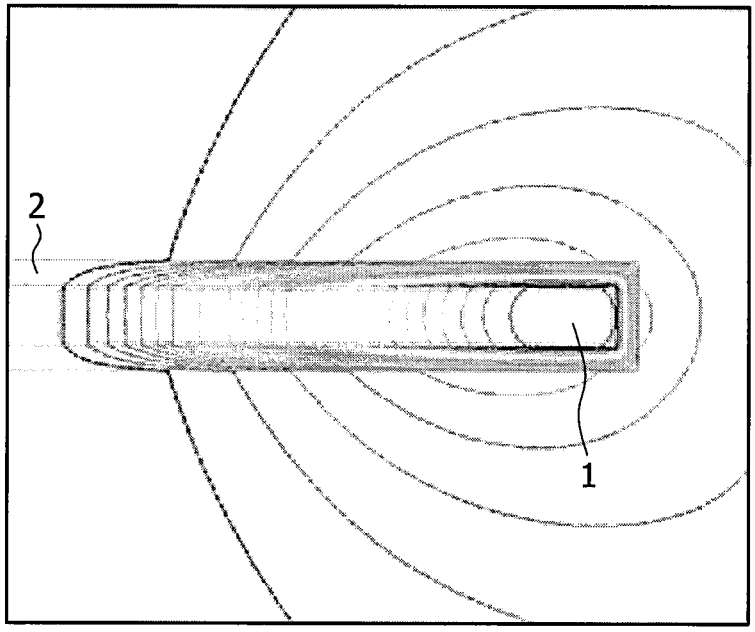
FIG. 15 is a magnetic flux line illustration in a case of setting the ratio R/W to "10"
Figure 16:
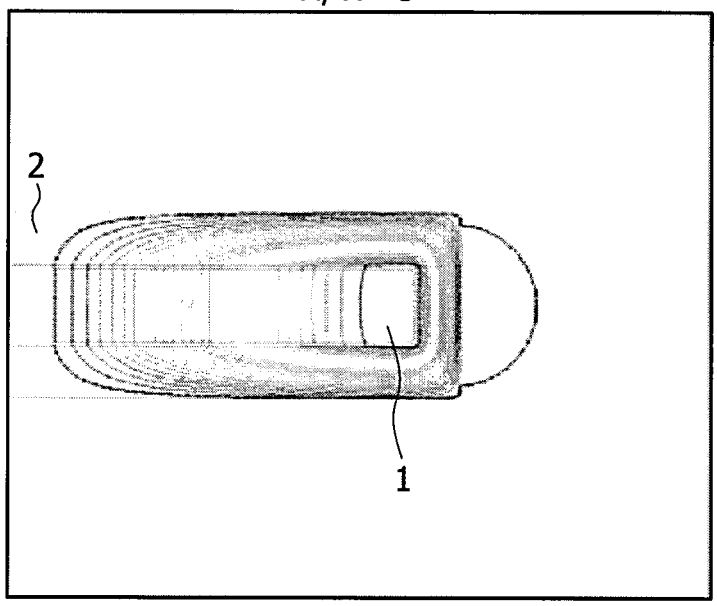
FIG. 16 is a magnetic flux line illustration in a case of setting the ratio R/W to "5"
Figure 17:
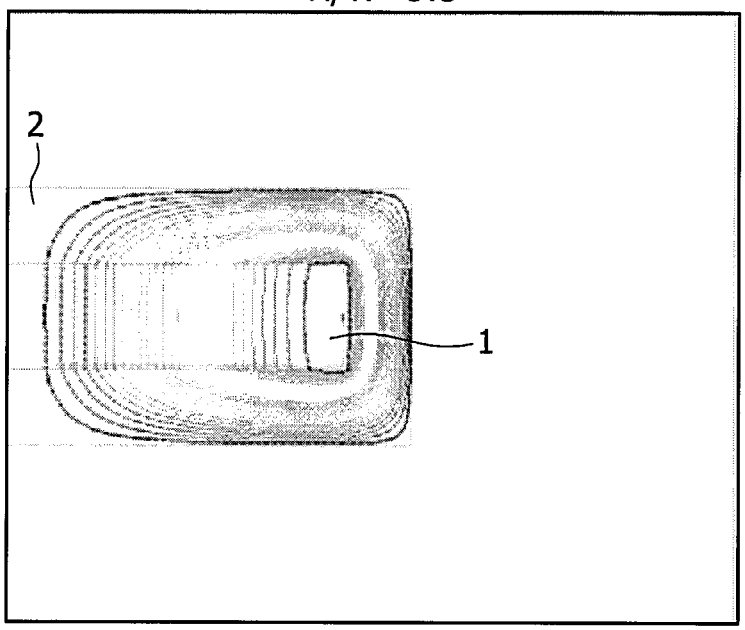
FIG. 17 is a magnetic flux line illustration in a case of setting the ratio R/W to "3.3"
Figure 18:
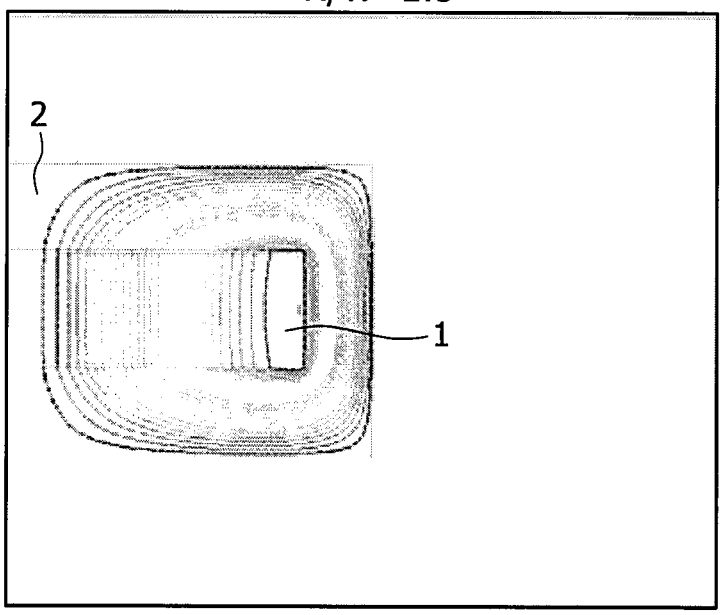
FIG. 18 is a magnetic flux line illustration in a case of setting the ratio R/W to "2.5"
Figure 19:
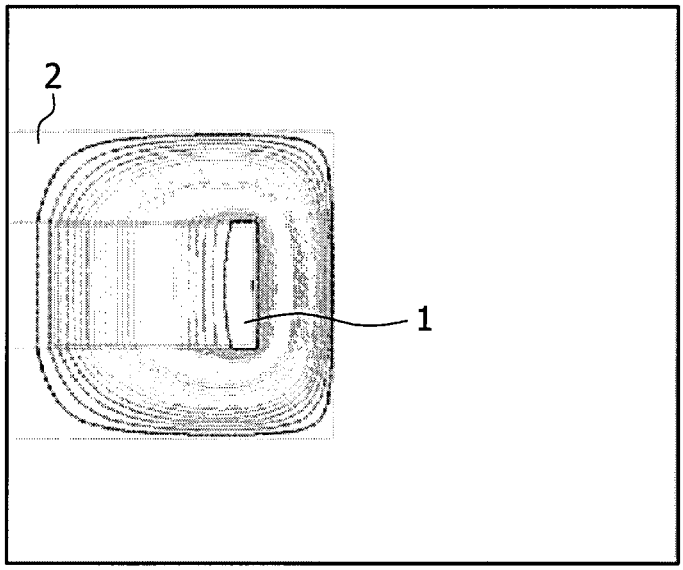
FIG. 19 is a magnetic flux line illustration in a case of setting the ratio R/W to "2"
Figure 20:
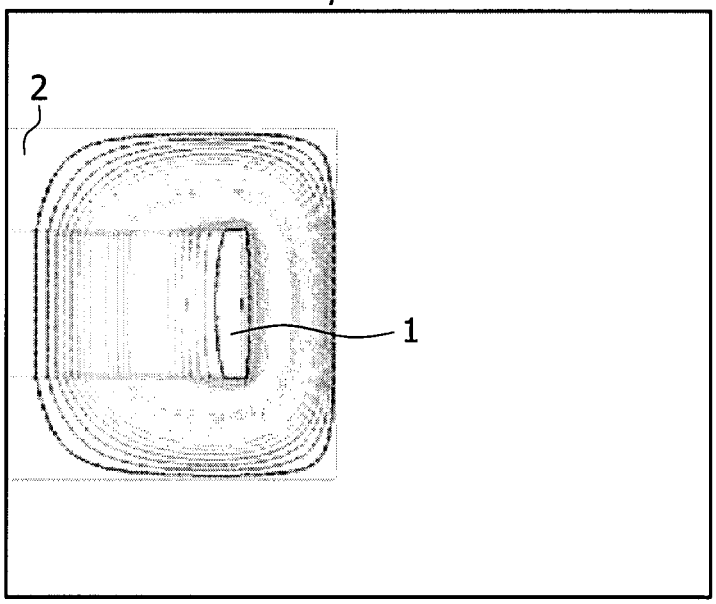
FIG. 20 is a magnetic flux line illustration in a case of setting the ratio R/W to "1.7"
Figure 21:
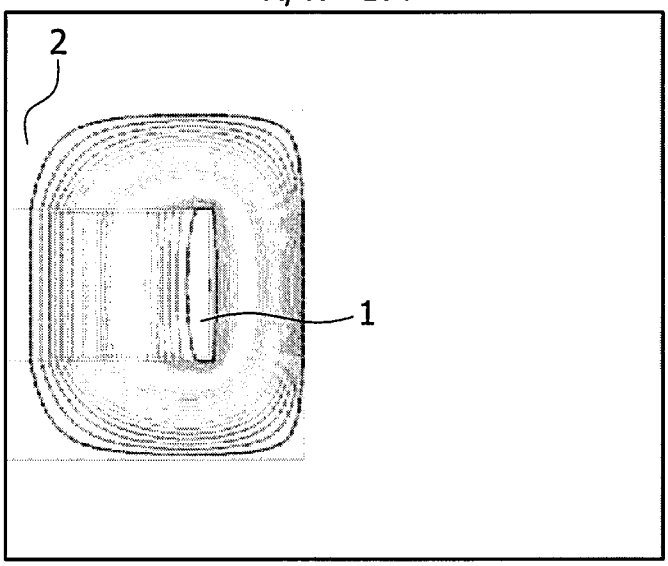
FIG. 21 is a magnetic flux line illustration in a case of setting the ratio R/W to "1.4"
Figure 22:
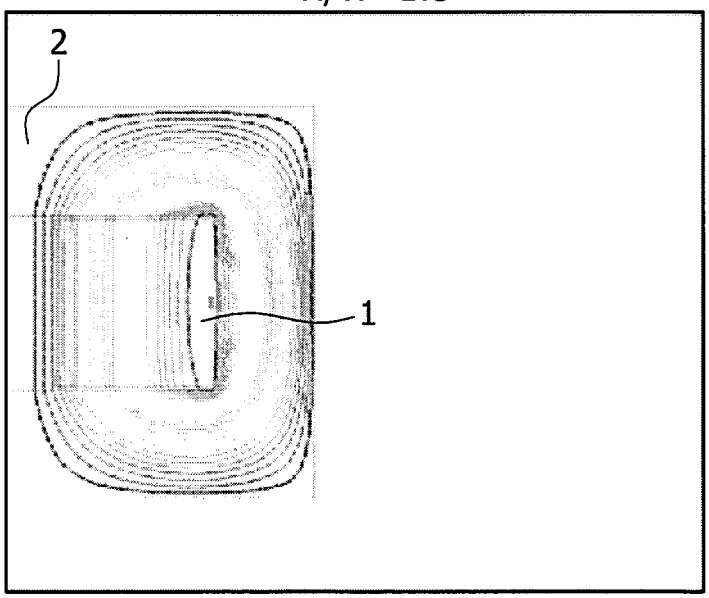
FIG. 22 is a magnetic flux line illustration in a case of setting the ratio R/W to "1.3"
Figure 23:
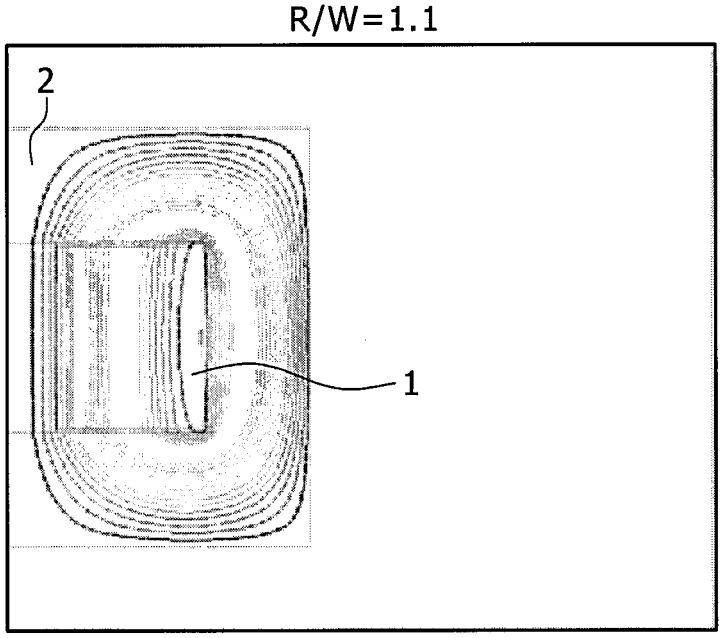
FIG. 23 is a magnetic flux line illustration in a case of setting the ratio R/W to "1.1"
Figure 24:
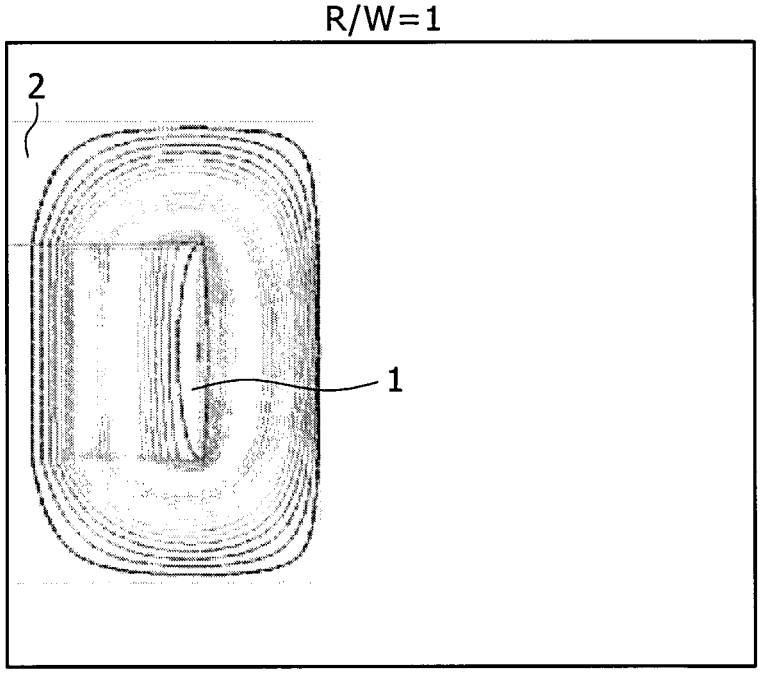
FIG. 24 is a magnetic flux line illustration in a case of setting the ratio R/W to "1"

It should be noted that, as shown in FIG. 14, in a case of projections h being present on the axis-center O side of the air-core coil 1, the magnetic flux lines close thereto may not be parallel to the axial direction depending on the shape thereof. Therefore, in the present embodiment, the core portion 2 is created so that the projection h is not formed. In order for the magnetic flux lines passing through the inside of the air-core coil 1 to become parallel, it is necessary to make the upper wall surface of the first core member 3 and the lower wall surface of the second core member 4 parallel at least in the region covering the ends of the air-core coil 1. The shapes and the like of the projection h that are permitted will be described later.

Furthermore, the present inventors focused on a ratio R/W of the radius R from the axis-center O of the air-core coil 1 to the outer circumferential surface of the air-core coil 1 (refer to FIG. 1) and the width W of the conductive member 10 configuring the air-core coil 1, and conducted simulation experiments for the forms of the magnetic flux line distribution when varying the ratio R/W.

FIGS. 15 to 24 are magnetic flux line illustrations of cases in which the ratio R/W is set to "10", "5", "3.3", "2.5", "2", "1.7", "1.4", "1.3", "1.1" and "1", respectively, while the overall volume of the reactor D1, the cross-sectional area of the rectangular cross section of the conductive member 10, and the winding number of the air-core coil 1 are each constant. In FIGS. 15 to 24, illustrations for the boundary line between adjacent winding wires are omitted.

As is evident from these magnetic flux line illustrations, in a case of the ratio R/W being set to at least 5 (cases shown in FIGS. 15 and 16), the magnetic flux of the core portion 2 is leaked to outside, and may affect peripheral equipment; therefore, there is a problem upon practical use. In addition, in a case of the ratio R/W being set to no more than 1.3 (cases shown in FIGS. 22 to 24), the magnetic flux lines passing through the inside of the air-core coil 1 are not parallel to the axial direction; therefore, the eddy current loss increases, and the efficiency may decline.

On the other hand, in order for an inverter equipped with the reactor D1 to have favorable controllability, the change in inductance relative to a change in current must be small and stable.

Herein, as an index expressing the stability of this inductance, the following is established in the present embodiment.

$$\text{Stability factor } I(\%)=\{(L\max-L\min)/Lav\}\times 100 \quad (1)$$

It should be noted that, in formula (1), Lmin is the inductance (hereinafter referred to as minimum inductance) at the smallest current in the range of current that can be supplied to the inverter (hereinafter referred to as usage range), Lmax is the inductance at the largest current in the usage range (hereinafter referred to as maximum inductance), and Lav is the average value of the plurality of inductances corresponding to the plurality of current values in the usage range, respectively (hereinafter referred to as average inductance). According to formula (1), the stability of the inductance increase with a smaller value of stability factor I.

Figure 25:
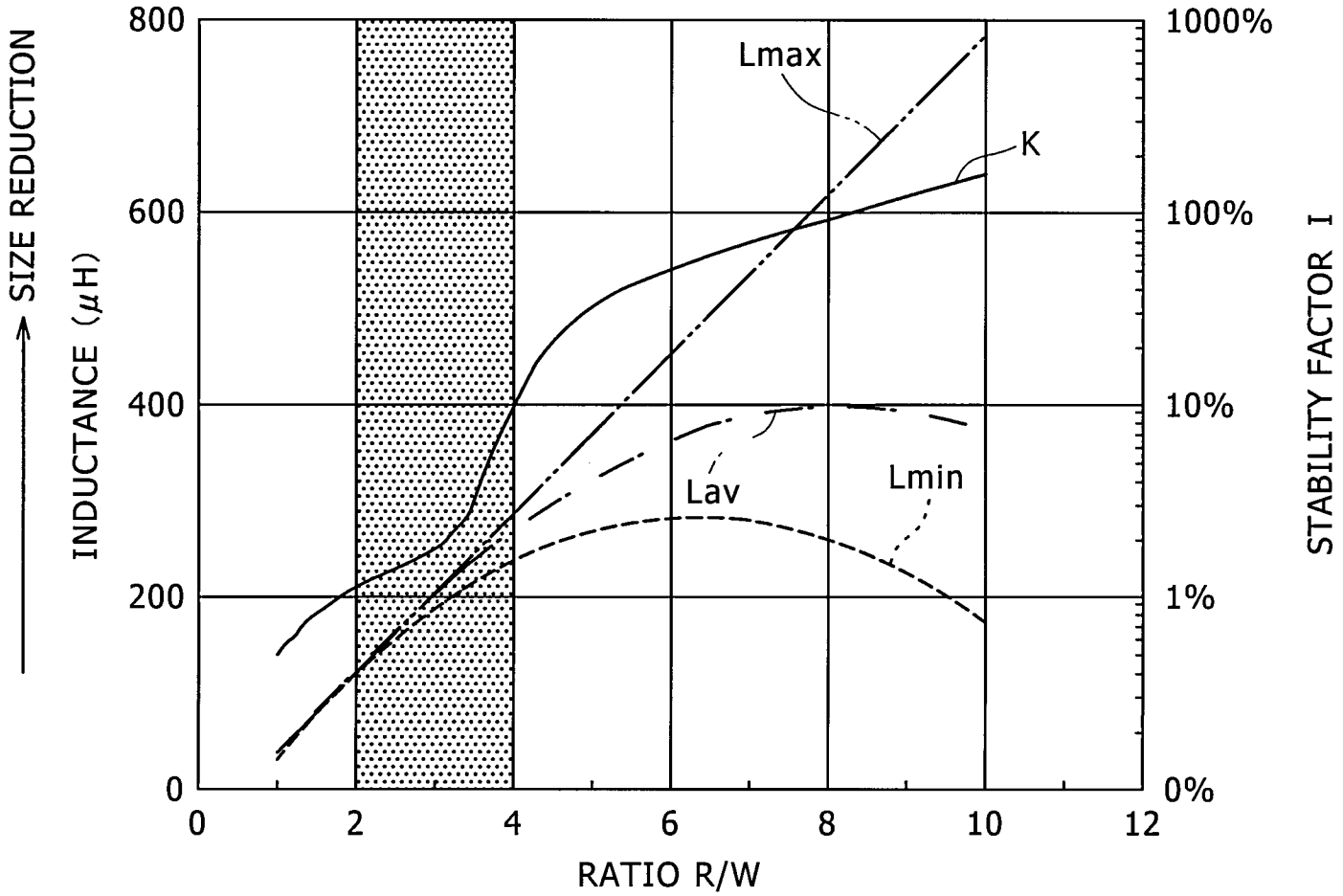
FIG. 25 is a graph with the ratio R/W as the horizontal axis, and the stability factor I and inductance as the vertical axis, showing a graph (graph K) expressing a change in stability factor I relative to a change in the ratio R/W, and a graph expressing changes in the maximum inductance Lmax, minimum inductance Lmin and average inductance Lav relative to the change in the ratio R/W.

The present inventors have studied the relationship between this stability factor I and the ratio R/W. FIG. 25 shows a graph K expressing the change in stability factor I relative to change in the ratio R/W, with the ratio R/W as the horizontal axis, and the stability factor I as the vertical axis. It should be noted that, in FIG. 25, graphs expressing the changes in the maximum inductance Lmax, minimum inductance Lmin and average inductance Lav relative to the change in the ratio R/W are also shown by expressing the inductance of each reactor with a separate vertical axis.

As shown in FIG. 25, the maximum inductance Lmax increases substantially proportional to the ratio R/W. In addition, the minimum inductance Lmin changes so as to have a mountain-shaped wave form that reaches the maximum when the ratio R/W is about 6. Moreover, the average inductance Lav changes so as to have a chevron-shaped wave form that reaches the maximum when the ratio R/W is about 8. From these results, the experimental results were obtained in that, although the increasing rate of the stability factor I differs depending on the value of the ratio R/W, the stability factor I generally increases accompanying the ratio R/W increasing.

In order to impart favorable control performance to an inverter, it is necessary for the stability factor I to be held to no more than 10%. Therefore, upon referencing FIG. 25, it is necessary to establish the ratio R/W to the following.

$$R/W\leq 4 \quad (2)$$

In addition, in a case of assuming, as the useful application of the reactor according to the present embodiment, for example, an inverter for industry such as electric railway cars, electric automobiles, hybrid automobiles, uninterruptible power supply, and solar power, or an inverter to be used in home appliances of significant power such as air-conditioners, refrigerators, and washing machines, a high inductance is demanded in the reactor since the electrical power to be handled is high. In such cases, an inductance of at least 100 μH is required. Therefore, upon referencing FIG. 25, it is necessary for the ratio R/W to be set to the following.

$$R/W\geq 2 \quad (3)$$

The present inventors have found the following as the requirement for the ratio R/W, based on formulae (2) and (3).

$$2\leq R/W\leq 4 \quad (4)$$

As explained above, the reactor D1 according to the present embodiment can cause a high inductance to be stably generated in a wide current range, while suppressing noise, manufacturing cost and eddy current loss, due to having the following configuration.

(1) The ratio t/W of the width W of the conductive member 10 to the thickness t of the conductive member 10 configuring the air-core coil 1 is no more than 1.

(2) The parallelism is established so as to make the inner wall face of the first core member 3 (upper wall surface) and the inner wall face of the second core member 4 (lower wall surface), which oppose both the upper and lower end faces of the air-core coil 1, appear parallel.

(3) The ratio R/W of the radius R from the axis-center O of the air-core coil 1 to the outer circumferential surface of the air-core coil 1 and the width W of the air-core coil 1 (conductive member) is at least 2 and no more than 4.

(4) Furthermore, among the respective parts of the core portion 2, the projections h are formed at positions facing the air-core part S1 of the air-core coil 1. The projections h are formed both on an upper-face side and bottom side of the core portion 2 towards the air-core coil 1. Herein, when taking the radius of the air-core part S1 of the air-core coil 1 as r, the height from the core surface facing the coil end of the projection h as a, and the radius at the bottom of the projection h as A, the inductance can be further improved when the projections h are formed so as to satisfy $0<a\leq W/3$ and $r>\sqrt{(A^2+(W/2)^2)}$.

When the projections h are provided at the core portion of the air-core part in this way, the place at which the magnetic flux passes through an air portion (i.e. portion amounting to great resistance for magnetic flux) narrows, the flow of magnetic flux improves, and the inductance increases.

Figure 26:
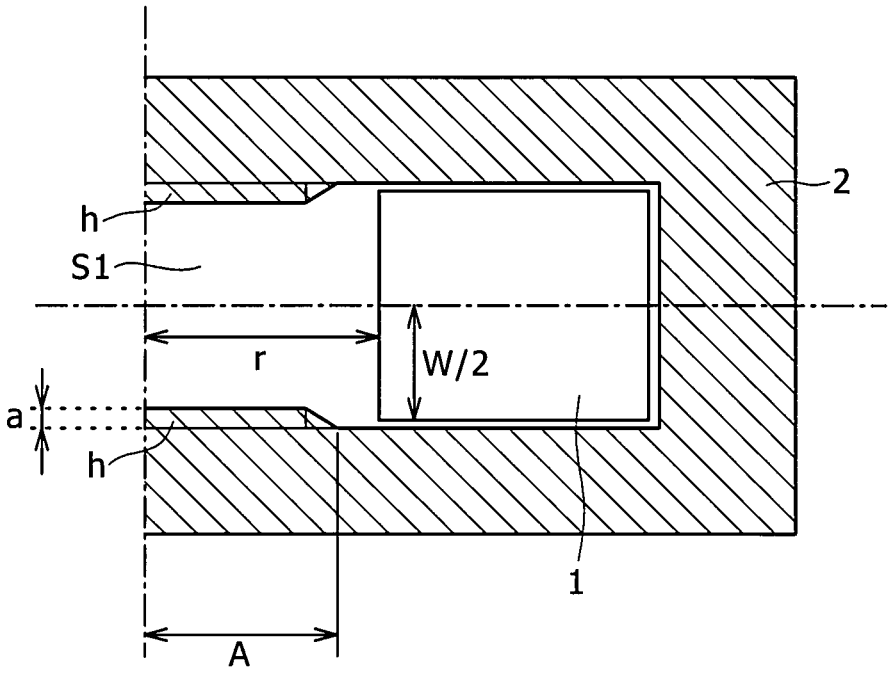
FIG. 26 is a schematic diagram of projections formed at the axis-center side.

However, when such projections h are present, the magnetic flux lines near the projections h will distort. As described above, for projections h of the shape such as that shown in FIG. 14, for example, the magnetic flux lines passing through the interior at a portion of the air-core coil 1 will not be parallel to the axial direction, and there is a possibility to lead to an increase in loss. As a result, in the case of providing the projections h, it is necessary to tune the shape of the projections h and the arrangement of the air-core coil 1, so as not to obstruct the magnetic flux lines passing through the inside of the air-core coil 1 from being parallel to the axial direction. FIG. 26 is a schematic diagram of the projections h formed at the core portion 2. As a result of the investigation of the present inventors, it was found that, when taking the radius of the air-core part of the air-core coil 1 as r, the height of the projection h from the surface of the core portion 2 facing the end of the air-core coil 1 as a, and the radius of the bottom of the projection h as A, the inductance increases when the projection h is formed so as to satisfy $0<a\leq W/3$ and $r>\sqrt{(A^2+(W/2)^2)}$. This is because the magnetic flux lines passing through the interior of the air-core coil 1 is not obstructed from being parallel along the axial direction, and the flow of magnetic flux improves.

Figure 27:
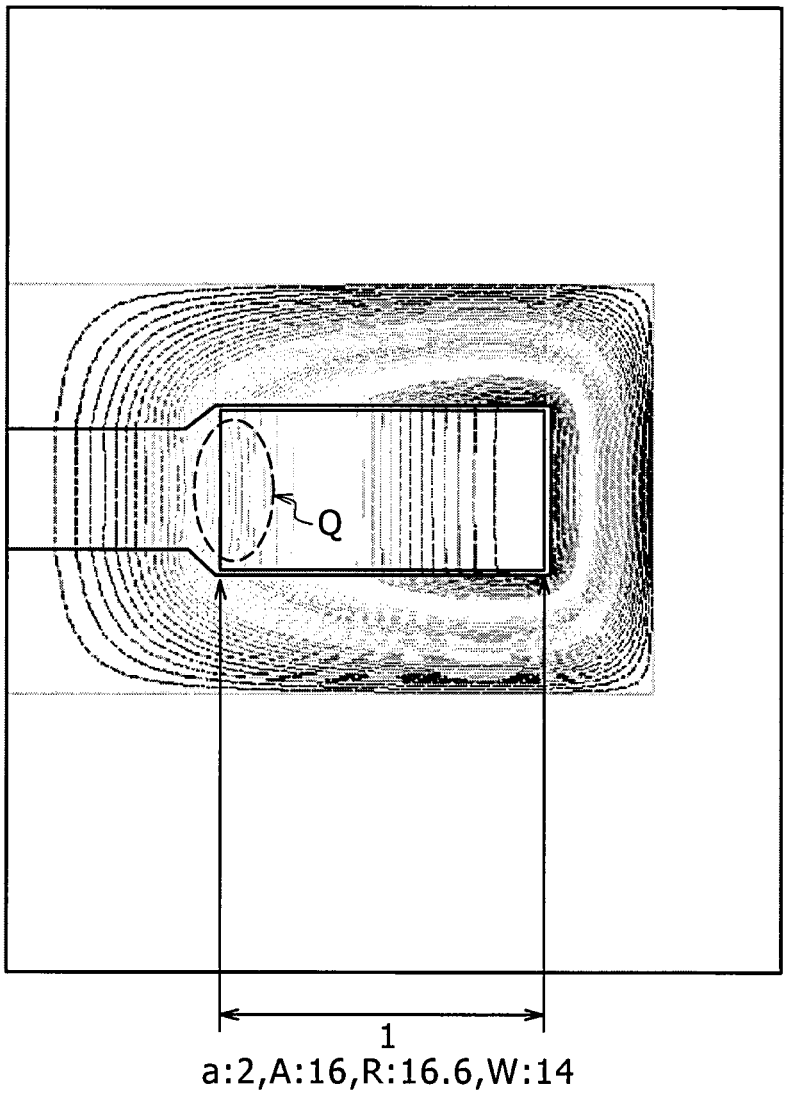
FIG. 27 is another example of a magnetic force line illustration in a case of projections h being present on the axis-center side.
Figure 28:
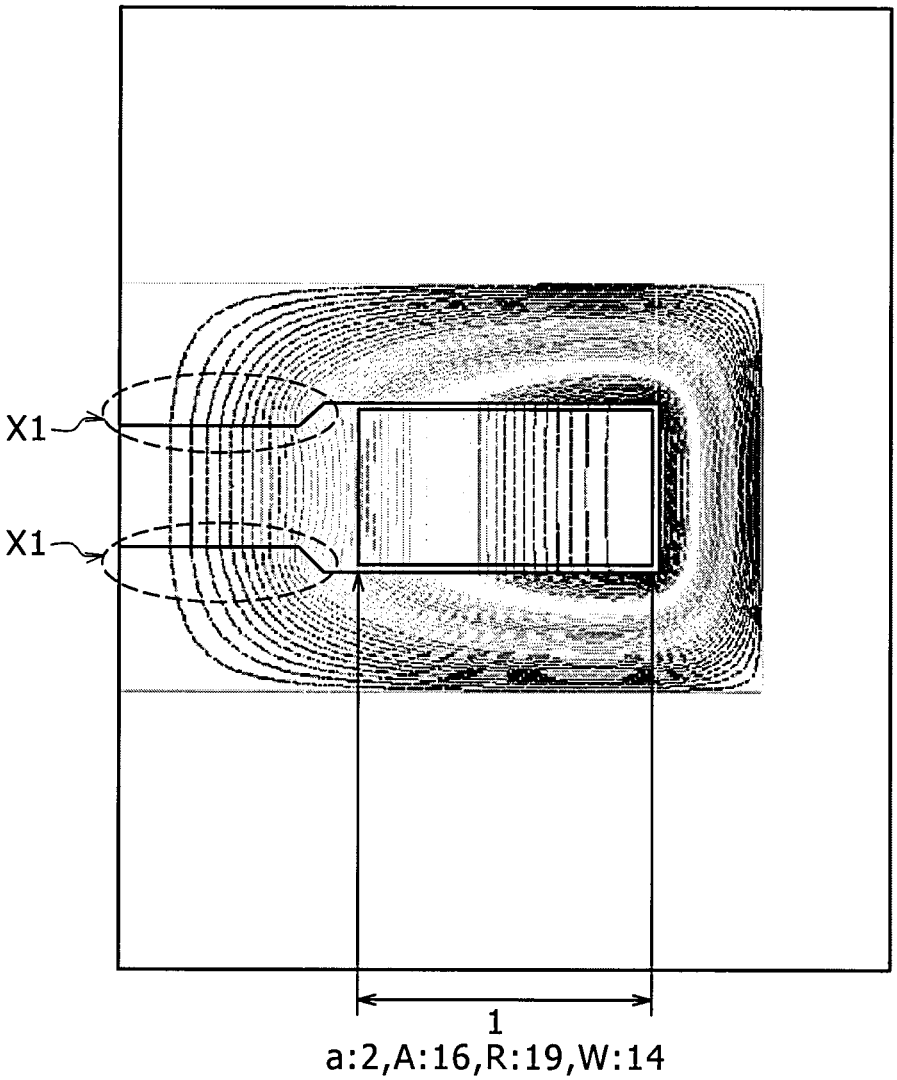
FIG. 28 is another example of a magnetic force line illustration in a case of projections h being present on the axis-center side.
Figure 29:
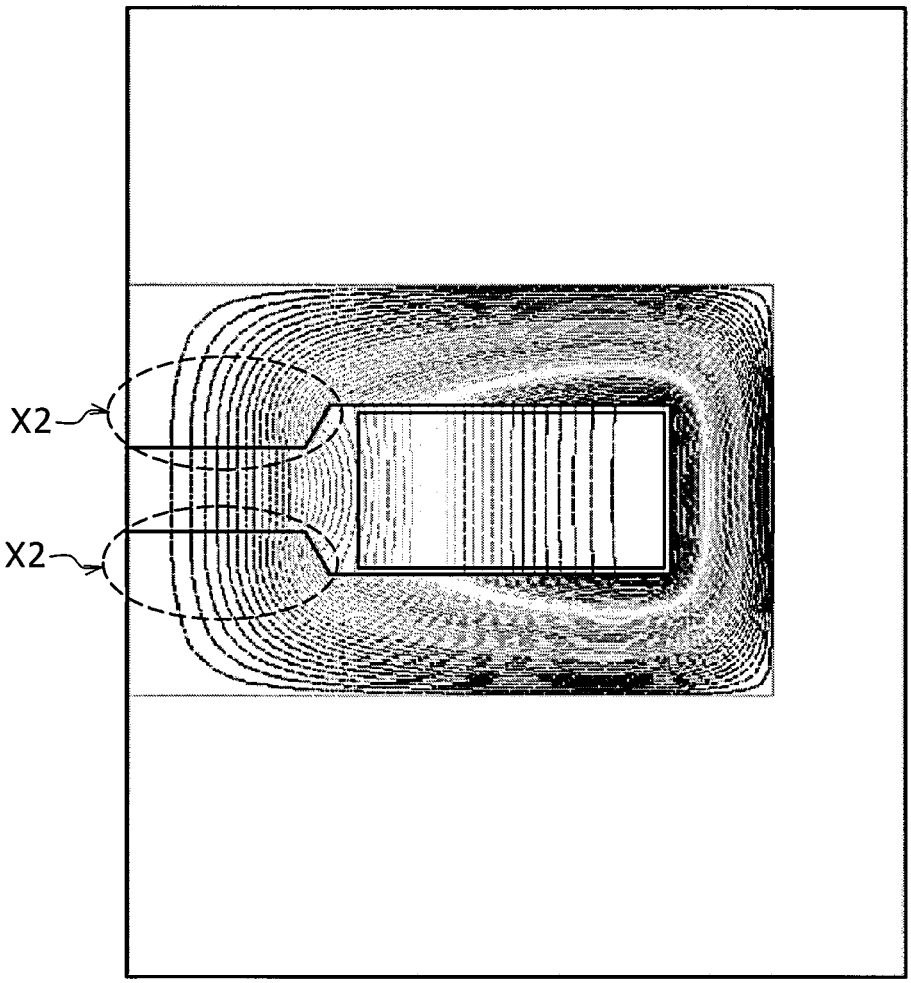
FIG. 29 is another example of a magnetic force line illustration in a case of projections h being present on the axis-center side.
Figure 30:
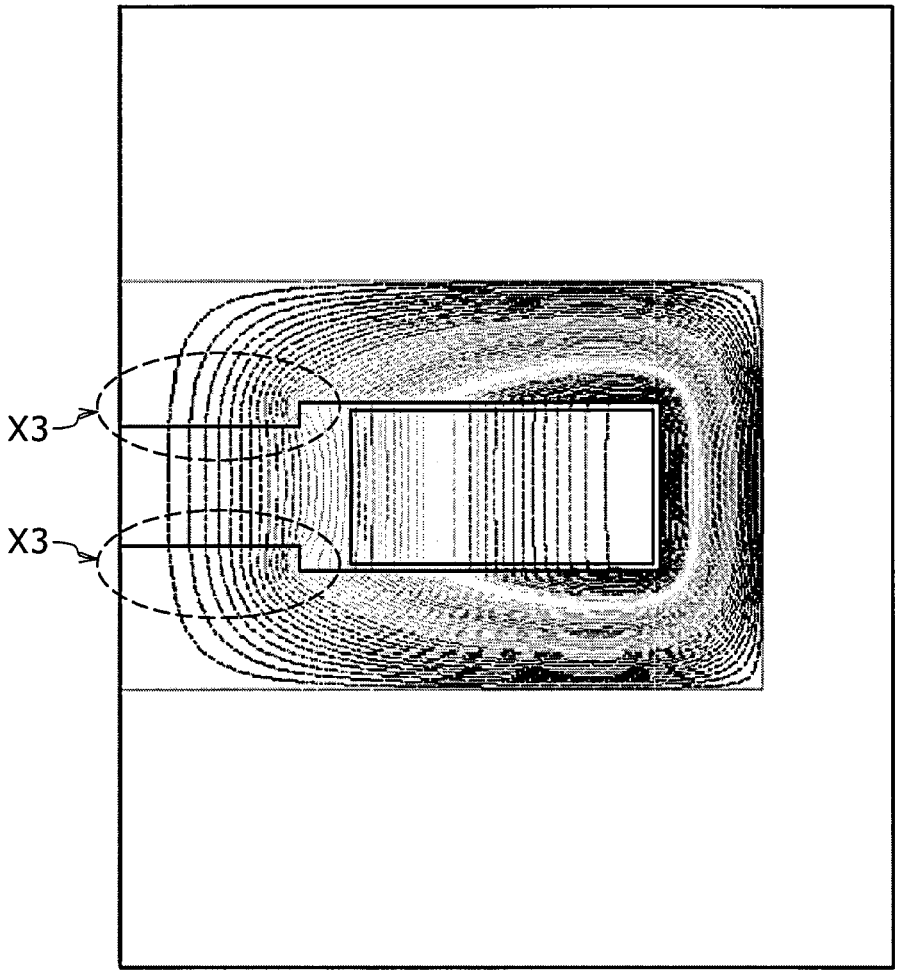
FIG. 30 is another example of a magnetic force line illustration in a case of projections h being present on the axis-center side.

FIGS. 27 to 30 show magnetic flux line illustrations when changing the above r, a, and A. The example shown in FIG. 27 is an example for which the requirement of $0<a\leq W/3$ is satisfied, but the requirement of $r>\sqrt{(A^2+(W/2)^2)}$ is not satisfied. In this example, the magnetic flux lines passing through the inside are not parallel to the axial direction in a portion of the air-core coil 1 (portion indicated by the arrow Q). However, in the examples shown in FIGS. 28 to 30, since the relationships of $0<a\leq 3$ and $r>\sqrt{(A^2+(W/2)^2)}$ are satisfied, the magnetic flux lines passing through the inside of the air-core coil 1 are parallel along the axial direction, while the magnetic flux line density near the projections is high, and thus it is found that an inductance improvement is achieved. In FIGS. 28 to 30, the shape of the core portion 2 is the same as the example shown in FIG. 27; however, the shapes of the projections h differ as shown at arrows X1 to X3.

Figure 31:
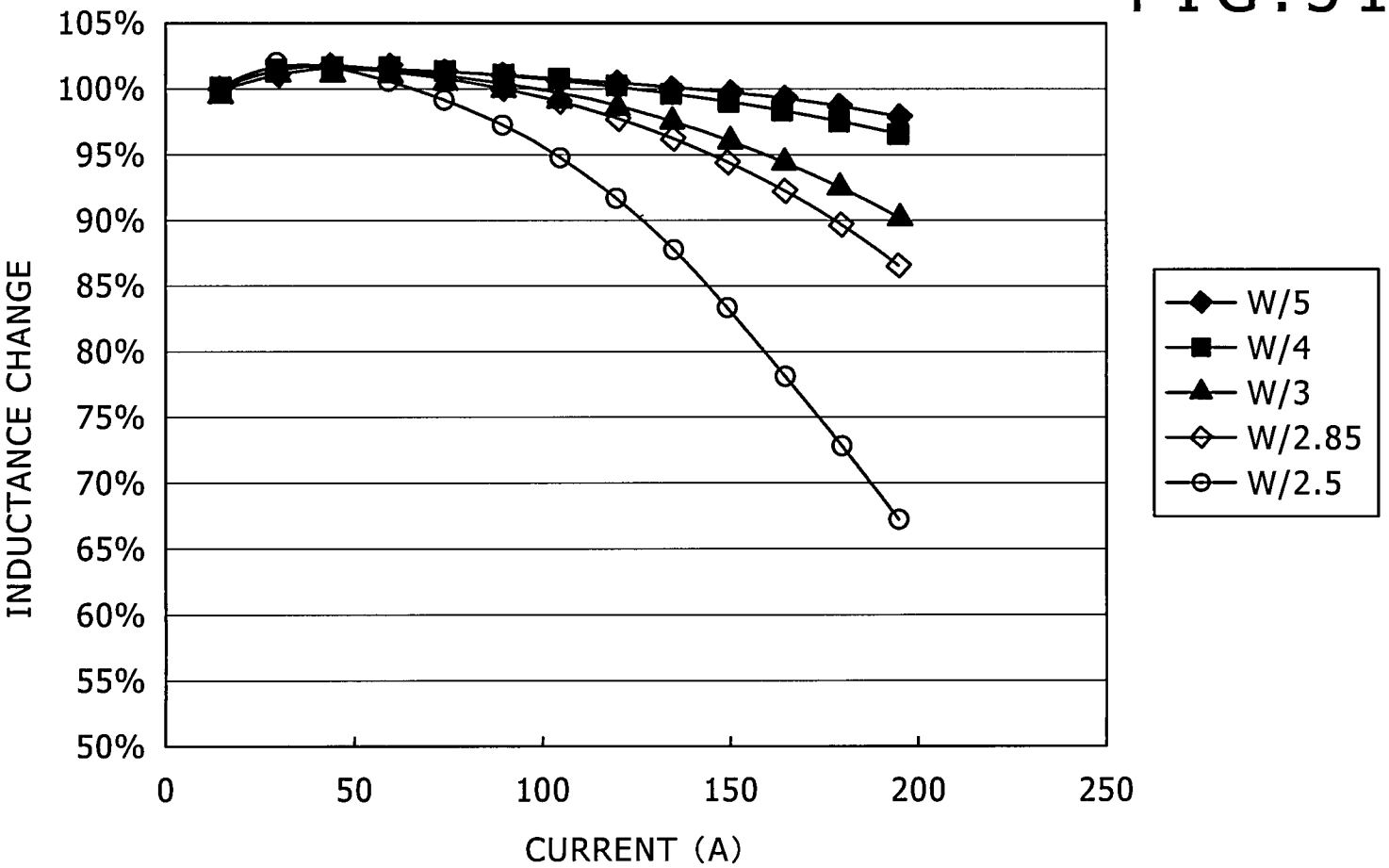
FIG. 31 shows a graph illustrating the state of inductance change in a case of varying the projection height a, with current as the horizontal axis and inductance change (%) as the vertical axis.

In addition, FIG. 31 shows a graph illustrating the aspect of inductance change in a case of varying the height a of the projection h, with current as the horizontal axis and inductance change (%) as the vertical axis. As is evident from FIG. 31, when a exceeds W/3, it becomes such that the percentage change for the change in inductance accompanying an increase in current exceeds 10%, and thus the stability factor deteriorates.

(5) Furthermore, by setting the ratio t/W to no more than 1/10, it is possible to further reduce the occurrence of eddy current loss.

(6) In addition, when the thickness t of the conductive member 10 is no more than a thickness δ determined according to the angular frequency, magnetic permeability and electrical conductivity (hereinafter referred to as skin thickness), it is effective in the reduction of eddy current loss.

In other words, since the current flowing in the air-core coil 1 only flows in the range until the skin thickness δ, it does not flow to inside of the conductive member 10, and current does not uniformly flow in the entire conductor cross section. This skin thickness δ is expressed as $\delta=(2\Omega\mu\sigma)^{1/2}$. Herein, ω is the angular frequency, μ is the magnetic permeability and σ is the electrical conductivity.

Herein, when the thickness of the conductive member 10 is made thicker than the skin thickness δ, the eddy current loss occurring inside of the conductive member 10 increases. Therefore, in the reactor D1 of the present embodiment, when the thickness t of the conductive member 10 is set to no more than δ, the eddy current loss can decrease.

(7) The absolute value of the value ((L1−L2)/L3) obtained by dividing the difference (L1−L2) of the space L1 between the upper wall surface of the first core member 3 and the lower wall surface of the second core member 4 at the innermost circumference position of the air-core coil 1, and the space L2 between the upper wall surface of the first core member 3 and the lower wall surface of the second core member 4 at the outermost circumference position of the air-core coil 1, by the average value L3 is set to no more than 1/50. Since the magnetic flux lines passing through the inside of the air-core coil 1 can thereby be parallel with the axial direction, it is possible to prevent or suppress the eddy current loss from increasing and thus prevent or suppress the inductance from decreasing.

It should be noted that the present case includes the following form, in place of the present embodiment or in addition to the present embodiment.

Figures 32A, 32B, 32C, 32D, 32E:
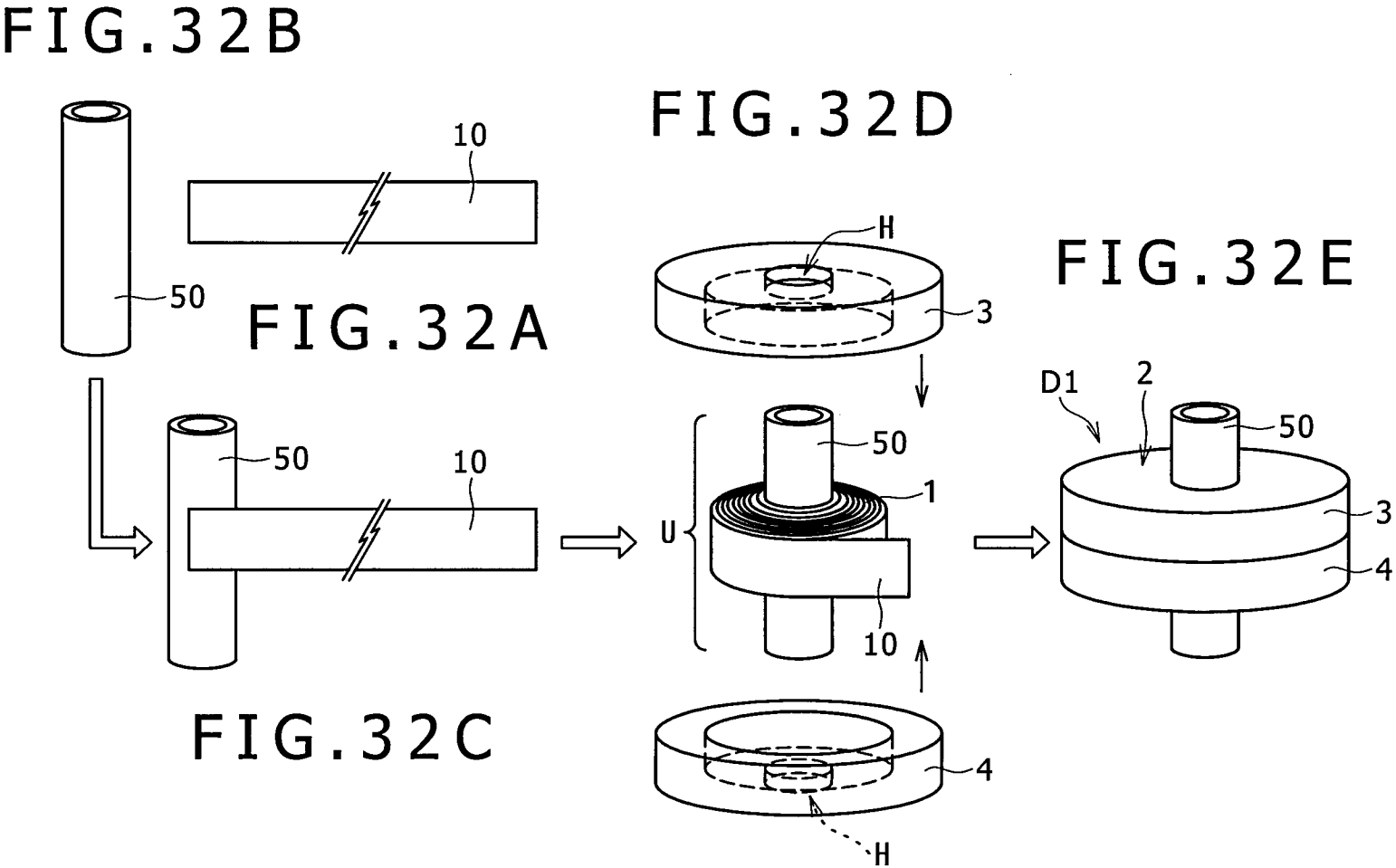
FIGS. 32(*a*), (*b*), (*c*), (*d*) and (*e*) are illustrations showing a preparation method of a reactor when a conductor of elongated shape projecting from the upper face and lower face of the core portion is provided to an air-core portion of the reactor.

(1) FIGS. 32(*a*) to (*e*) are illustration showing a preparation method of the reactor in a case of a conductor 50 of elongated shape projecting from the upper face and lower face of the core portion 2 being provided to the air-core part in the reactor. As shown in FIG. 32(*d*), a hole H of the same diameter as the air-core part S1 may be formed in a part of the core portion 2 corresponding to the air-core part S1 of the air-core coil 1, and the conductor 50 penetrating the core portion 2 may be installed through this hole H. The conductor 50 serves as a lead of the coil of elongated shape. It should be noted that, although a conductor 50 of cylindrical shape is shown in FIG. 32(*b*), the same inductance characteristic will be obtained with a cylindrical shape and a solid columnar shape.

However, if the conductor 50 is in a cylindrical shape, it is possible to actively cool the reactor by flowing water or air through the hollow interior. Therefore, when the conductor 50 is in a cylindrical shape, a higher cooling performance can be imparted to the reactor than when in a solid columnar shape.

In addition, in a case of the conductor penetrating from the top and bottom faces of the first and second core members 3 and 4, respectively, the radiating performance of the reactor D can be improved.

A reactor having such a configuration can be manufactured according to the following processes, for example. First, an end of the ribbon-shaped conductive member 10 (FIG. 32(*a*)) having a predetermined thickness is joined (FIG. 32(*c*)) at the proper place on the peripheral surface of the conductor 50 of cylindrical shape (FIG. 32(*b*)). Subsequently, the conductive member 10 is wound around a predetermined number of times, as shown in FIG. 32(*d*). A unit having the air-core coil 1 of a pancake structure is thereby formed.

Next, as shown in FIG. 32(*d*), parts of the conductor 50 projecting above and below this unit, respectively, are made to penetrate the holes H formed in the first and second core members 3 and 4, respectively, and then the first and second core members 3 and 4 are superimposed so as to sandwich the air-core coil 1. A reactor of a disc shape, for example, having projections at the upper and lower faces is thereby created, such as that shown in FIG. 32(*e*).

In this way, in the present embodiment, the conductor 50 of elongated shape and the ribbon-shaped conductive member 10 are electrically connected by coupling the end of the ribbon-shaped conductive member 10 to the proper place on the peripheral surface of the conductor 50 of elongated shape penetrating the core portion 2, and the ribbon-shaped conductive member 10 is wound a predetermined number of times around the conductor 50 of elongated shape, thereby preparing the air-core coil 1. The conductor 50 of elongated shape can thereby possess both a function as one electrode among the electrodes to be installed to the air-core coil 1, and a function as a base material when manufacturing the air-core coil 1 (winding the conductive member of ribbon shape).

It should be noted that, when the conductor of elongated shape is configured by a metal having high thermal conductivity, the radiation of heat from the inside of the reactor can be improved.

(2) As in the modified embodiment (1), in a case of the conductor 50 of cylindrical shape being installed in the air-core part S1, the thickness of the conductor 50 is set to be at least twice the skin thickness $\delta=(2/\omega\mu\rho)^{1/2}$ relative to the drive frequency of the reactor D1. In this case, by way of the skin effect of the conductor 50 (shielding effect of the AC magnetic flux), it is possible to make the magnetic flux lines at an edge portion of the air-core coil 1 forcibly oriented perpendicularly, so that the AC magnetic flux lines do not penetrate to inside of the cylinder of the conductor 50. As a result, a bolt or the like for fixing can be inserted through the cylinder of the conductor 50 without affecting the reactor characteristics. Therefore, the degrees of freedom in the shape of the reactor D1 and the installment form can be increased, without a restriction on the diameter of the conductor being imposed.

In addition, according to the conductor 50, it is possible to impart a filter function since the harmonic component generates heat efficiently.

Figure 33B:
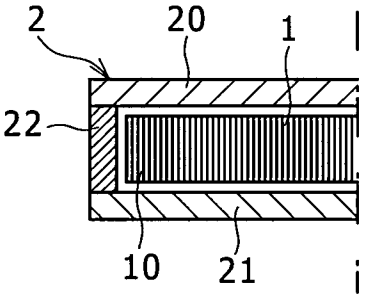
FIGS. 33(*a*) and (*b*) are illustrations showing a modified embodiment of a core portion.
Figure 33A:
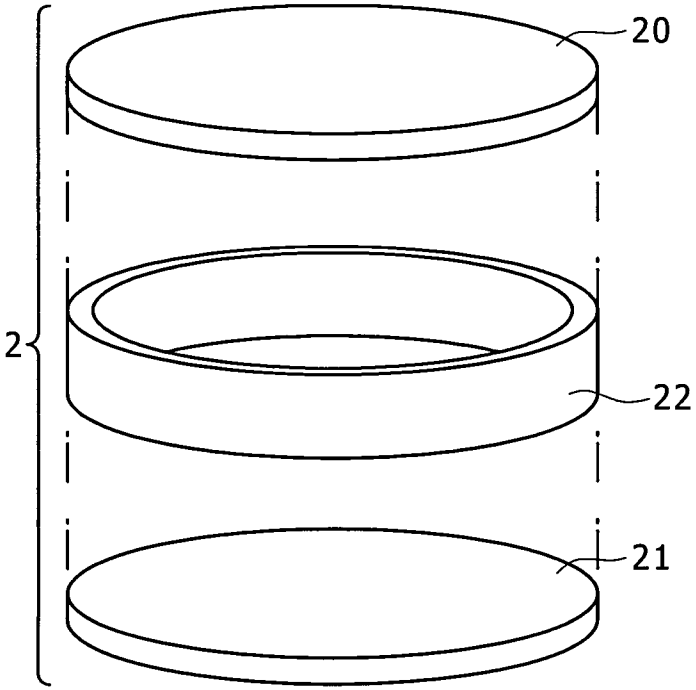

(3) In addition to being created by the first and second core members 3 and 4 as in the first embodiment, the core portion 2 may be such as that shown in FIGS. 33(*a*) and (*b*), for example. FIG. 33 is an illustration showing a modified embodiment of the core portion 2, with FIG. 33(*a*) being an assembling perspective view of the core portion 2 of a reactor according to the present modified embodiment, and FIG. 33(*b*) being a cross-sectional view sectioning the reactor according to the present modified embodiment in a plane including the axis-center O. Herein, the core portion 2 includes first and second disc core members 20 and 21 of disc shape having a diameter larger than the outside diameter of the air-core coil 1 by at least the thickness t of the conductive member 10, and a cylindrical coil member 22 having a columnar outer circumference of the same diameter as the core members 20 and 21. The first and second disc core members 20 and 21 are attached to each end of the cylindrical core member 22.

It should be noted that, in the aforementioned reactor D1, the air-core coil 1 and the core portion 2 are basically columnar in external form; however, they are not limited thereto, and may be the shape of a polygonal pillar. The polygonal pillar shape is quadrangular pillar shape, hexagonal pillar shape, octagonal pillar shape, or the like, for example. In addition, the air-core coil and core portion may be a columnar shape and polygonal pillar shape. For example, the air-core coil may be a columnar shape, and the core portion may be a polygonal pillar shape. Furthermore, the air-core coil may be a polygonal pillar shape, and the core portion may be the shape of a columnar shape, for example. Herein, a reactor D2 in which the air-core coil and the core portion are quadrangular pillar shapes will be explained as one example.

Figure 34:
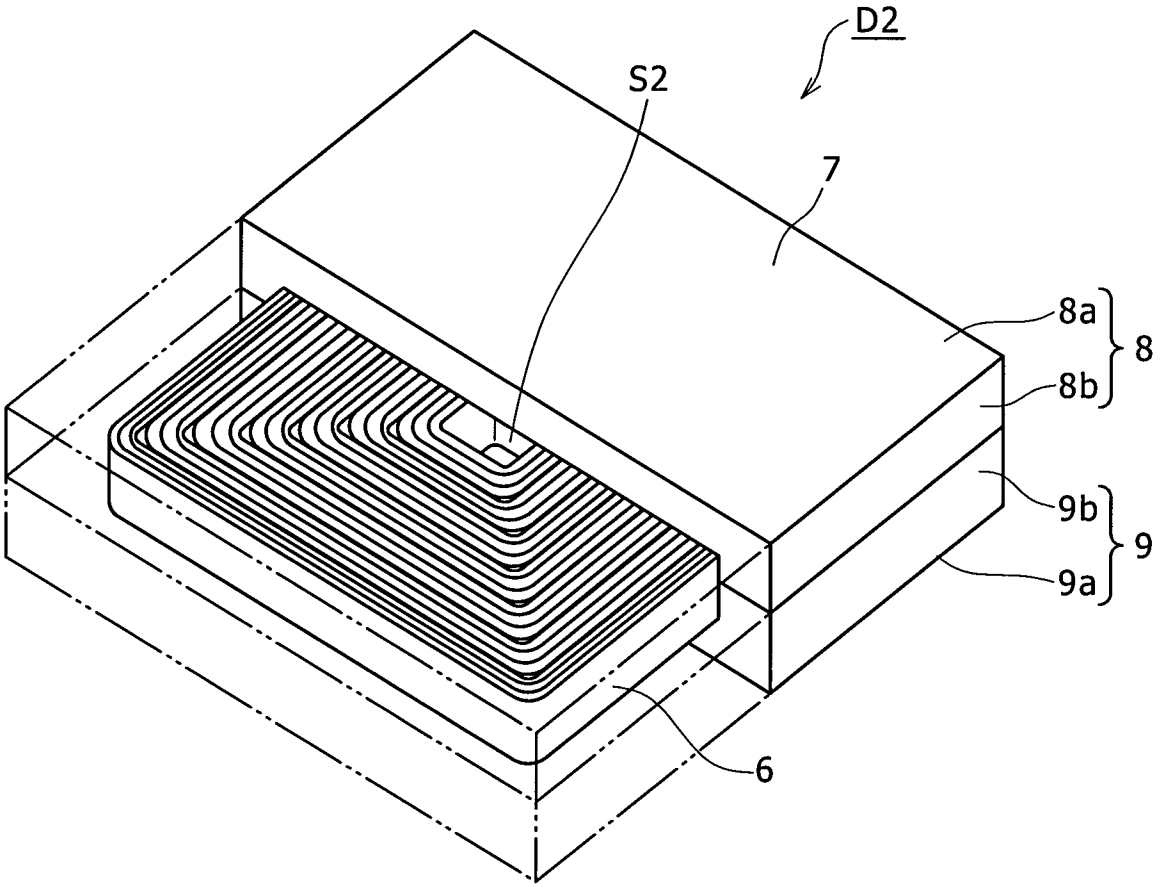
FIG. 34 is a partially transparent perspective view showing the configuration of a reactor according to another embodiment.
Figure 35:
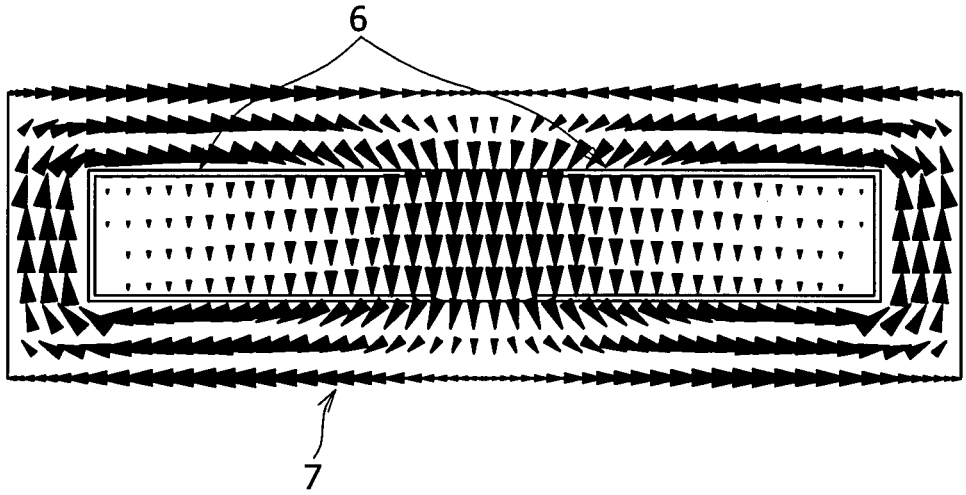
FIG. 35 is an illustration showing the magnetic flux density of the reactor, shown in FIG. 34, by vectors.
Figure 36:
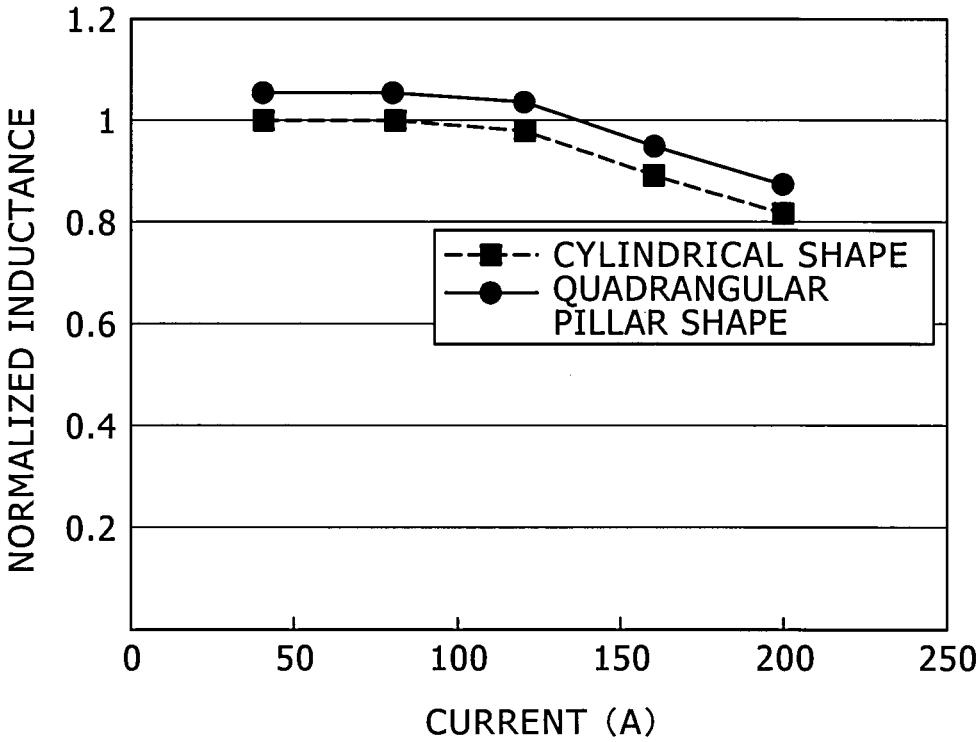
FIG. 36 is a graph showing the inductance characteristic of the reactor shown in FIG. 34.

FIG. 34 is a partially transparent perspective view showing the configuration of the above-mentioned reactor D2. FIG. 34 is illustrated with substantially half of the core portion made transparent so that the configuration of the coils inside can be seen. FIG. 35 is an illustration showing the magnetic flux density of the reactor shown in FIG. 34 by vectors. In FIG. 35, a cross-sectional view of the reactor is shown for a case of being sectioned in a substantially central plane including the axis-center, so as to halve the core portion. FIG. 36 is a graph showing the inductance characteristic of the reactor shown in FIG. 34. The horizontal axis in FIG. 36 is the current (A), and the vertical axis is the inductance (μL).

This reactor D2 of quadrangular pillar shape is configured to include an air-core coil 6 having a flat-wise winding structure, and a core portion 7 covering the air-core coil 6, as shown in FIG. 34. It should be noted that, in the case of the air-core coil being a polygonal pillar shape, the radius R of the air-core coil is replaced with the shortest distance R from the center of the air-core coil to the outer peripheral surface.

Similarly to the core portion 2, the core portion 7 includes first and second core members 8 and 9, which have magnetic (e.g., magnetic permeability) isotropy as well as having identical configurations. The first and second core members 8 and 9 are respectively configured so as to have tube parts 8*b* and 9*b* of a quadrangular shape in a cross section, having a periphery of the same size as the size of a quadrangle formed by the four sides of angular-plate parts 8*a* and 9*a* having a quadrangular shape (rectangular shape), for example, continuous from the plate surface of the angular-plate parts 8*a* and 9*a*. A core portion 7 is provided with a space for accommodating the air-core coil 6 inside by the first and second core members 8 and 9 being superimposed with each other along the end faces of the respective tube parts 8*b* and 9*b*.

Then, an air-core part S2 of quadrangular pillar shape having a quadrangle form of a predetermined size at the center (axis-center O) is provided to the air-core coil 6. The air-core coil 6 is formed by a ribbon-shaped conductive member having a predetermined thickness being wound around a predetermined number of times so that the external form thereof becomes a quadrangular pillar shape in a state in which the width direction thereof is made to substantially match the axis-center direction. The air-core coil 6 is installed at the internal space of the core portion 7 (space formed by the inner wall faces of the first and second core members 8 and 9).

According to such a configuration as well, the magnetic flux lines inside of the air-core coil 6 will be substantially parallel along the axial direction, as shown in FIG. 35, and thus have a similar functional effect as the reactor D1 shown in FIG. 1. Moreover, as is evident from FIG. 36, the inductance of the reactor D2 of such a configuration is higher than the inductance of the reactor D1 shown in FIG. 1. It should be noted that, as shown in FIG. 36, the inductance characteristic of the reactor D2 of such a configuration is a similar profile to the inductance characteristic of the reactor D1 shown in FIG. 1. Theses inductances are substantially constant in the range of relatively small current values (range no more than about 80 A in FIG. 36), and gently decrease accompanying an increase in the current passing therethrough when exceeding this range.

Herein, the reactor D1 of the configuration shown in FIG. 1 and the reactor D2 of the configuration shown in FIG. 34 are compared under conditions in which the inductances are substantially the same at 40 A in FIG. 36.

(4) A magnetic substance of low magnetic permeability may be filled into the space (space for containing the air-core coil 1) formed inside of the core portion 7 according to the modified embodiment (3), or inside of the core portion 2 according to the first embodiment.

(5) An insulating material such as BN (boron nitride) ceramics, for example, may be filled between the upper end face of the air-core coil 1,6 and the inner wall face of the core portion 2,7 facing this, and between the lower end surface of the coil 1,6 and the core portion 2,7 facing this. For example, a resin sheet having insulating property and good thermal conductivity is assumed as the insulating material. The thickness of the insulating material is preferably no more than 1 mm. It should be noted that the insulating material may be configured by filling with a compound.

With this insulating material, the thermal conductance in the axial direction (vertical direction) by the air-core coil 1 improves and the Joule heat generating in the air-core coil 1 can be made to thermally conduct to the core portion 2,7 via the insulating material, whereby it is possible to more efficiently discharge heat to outside. In addition, if specifically made so that the core portion 2 is cooled from the outside, it is possible to further prevent the inside of the reactor D1,D2 from becoming high temperature because of this.

Figure 37A:
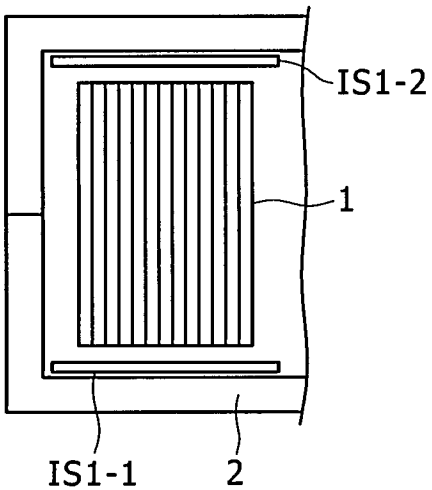
FIGS. 37(A), (B) and (C) are illustrations showing the configuration of a part of the reactor further including an insulating member for insulation resistance.
Figure 37B:
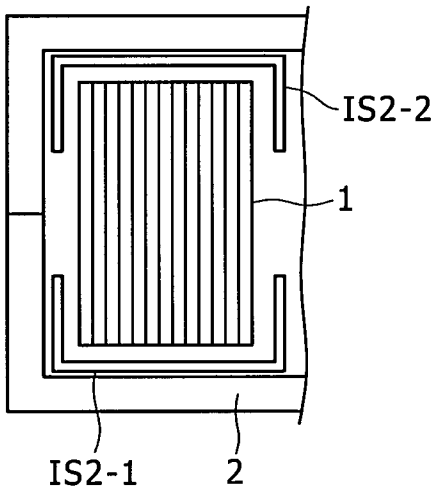
Figure 37C:
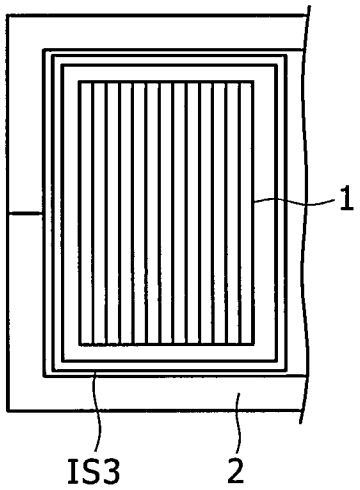
Figures 38, 39:
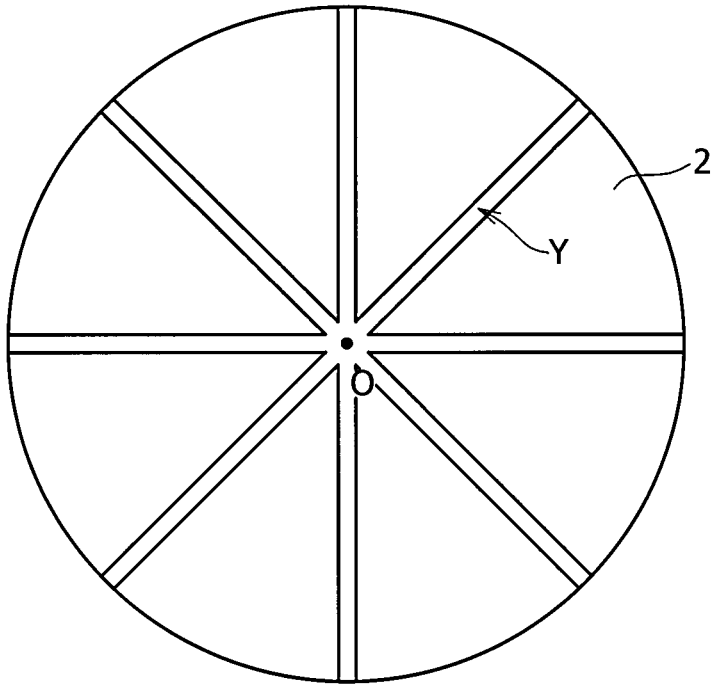
FIG. 38 is a table showing the results of the dielectric strength voltage (2.0 kV) relative to different materials and different thicknesses (μm) of insulating members for a reactor of the configuration shown in FIG. 37(A)
FIG. 39 is a view showing another modified embodiment of the core portion.

(6) FIGS. 37(A), (B) and (C) are illustrations showing the configuration of parts of reactors further including an insulating member for insulation resistance. FIG. 37 is an illustration showing a portion of a reactor including an insulating member, with FIG. 37(A) showing an insulating member of a first form, FIG. 37(B) showing an insulating member of a second form, and FIG. 37(C) showing an insulating member of a third form. FIG. 38 is a table showing the results for the dielectric strength voltage (2.0 kV) relative to the material and thickness (μm) of the insulating member for the reactors of the configuration shown in FIG. 37(A).

In the reactor D1 of the aforementioned embodiment, in order to further improve the insulation resistance between the air-core coil 1 and the core portion 2, an insulating member IS may be further provided between one end of the air-core coil 1 and one core portion surface facing this one end, and between one other end of the air-core coil 1 and one other core portion surface facing this one other end.

Such an insulating member IS is a resinous sheet having heat resistance such as PEN (polyethylene terephthalate) or PPS (polyphenylene sulfide), for example. For example, as shown in FIG. 37(A), the insulating member IS may be a sheet-like insulating member IS1-1 disposed between one end of the air-core coil 1 and one core portion surface facing this one end, and a sheet-like insulating member IS1-2 disposed between one other end of the air-core coil 1 and one other core portion surface facing this one other end. In addition, as shown in FIG. 37(B), for example, the insulating member IS may be a sheet-like insulating member IS2-1 covering one portion of the inner periphery and one portion of the outer periphery of the air-core coil 1, respectively, as well as being disposed between one end of the air-core coil 1 and one core portion surface facing this one end; and a sheet-like insulating member IS2-2 covering one portion of the inner surface and one portion of the outer surface of the air-core coil 1, respectively, as well as being disposed between one other end of the air-core coil 1 and one other core portion surface facing this one other end. In addition, as shown in FIG. 37(C), for example, so as to encapsulate the air-core coil 1, the insulating member IS may be an insulating member IS3 covering the entirety of the inner periphery and the outer periphery of the air-core coil 1, as well as being disposed so as to cover the entirety of the one end and the other one end of the air-core coil 1. It should be noted that, although the case of the reactor D1 has been explained in the aforementioned explanation, the case of the reactor 2 can be explained in a similar way as well.

By further including the insulating member IS of such a configuration, it is possible to further improve the dielectric strength between the air-core coil and the core portion.

Herein, the dielectric strength voltage of the reactor D1 further including the insulating members IS1-1 and IS1-2 of the first form shown in FIG. 37(A) is shown in FIG. 38. Herein, FIG. 38 shows the results of the dielectric strength voltage in a case of applying a voltage of 2.0 kV, for each case of kapton sheets (polyimide) being used as the insulating members IS1-1 and IS1-2, and the thickness thereof being 25 μm, 50 μm, and 100 μm. In addition, FIG. 38 shows the results of the dielectric strength voltage in a case of applying a voltage of 2.0 kV, for each case of PEN sheets being used as the insulating members IS1-1 and IS1-2, and the thickness thereof being 75 μm and 125 μm. Furthermore, FIG. 38 shows the results of the dielectric strength voltage in a case of applying a voltage of 2.0 kV, for a case of PPS sheets being used as the insulating members IS1-1 and IS1-2, and the thickness thereof being 100 μm. Moreover, FIG. 38 shows the results of the dielectric strength voltage in a case of applying a voltage of 2.0 kV, for a case of nomex being used as the insulating members IS1-1 and IS1-2, and the thickness thereof being 100 μm. As is evident from FIG. 38, favorable insulation is obtained between the air-core coil 1 and the core portion 2 in the case of kapton sheets (polyimide) of 100 μm thickness being used as the insulating sheets IS1, in the case of PEN sheets of 125 μm thickness being used thereas, in the case of PPS sheets of 100 μm thickness being used thereas, and in the case of nomex of 100 μm thickness being used thereas. Therefore, the thickness of the insulating member IS is preferably at least 100 μm.

(7) FIG. 39 is a plan view showing a modified embodiment of the core portion 2. As shown in FIG. 39, a plurality of concave grooves Y is radially provided from the vicinity of the axis-center O towards the outer circumferential side in the upper face of the core portion 2. By circulating a cooling medium such as air or cooling water along these concave grooves Y so as to forcedly cool the core portion 2, the radiating performance of the reactor D1 can be improved.

Figure 40A:
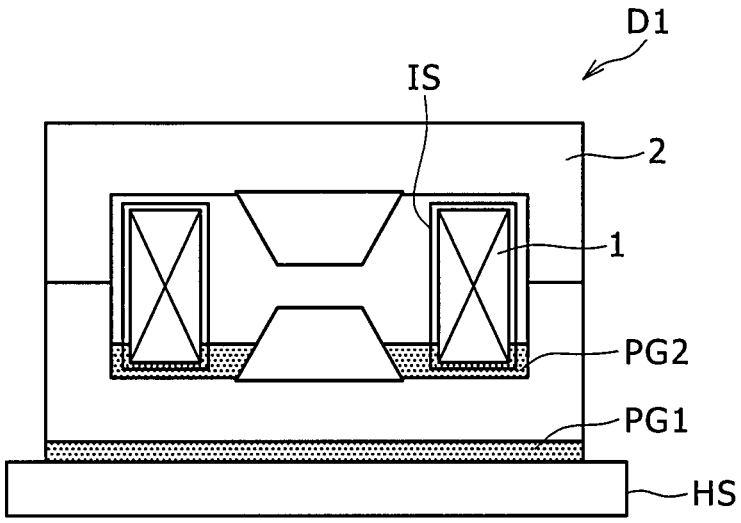
FIGS. 40(A) and (B) are illustrations showing the configuration of a reactor of a first form further including a heat sink.

(8) FIGS. 40(A) and (B) are illustrations showing the configuration of a reactor of a first form further including a heat sink. FIGS. 41(A) and (B) are illustrations showing the configuration of a reactor of a second form further including a heat sink. FIGS. 42(A) and (B) are illustrations showing the configuration of a reactor of a third form further including a heat sink. In these FIGS. 40 to 42, (A) shows the overall configuration, and (B) shows a portion of a heat-transfer member inside of the core portion 2. FIG. 43 is an illustration showing the configuration of a reactor of a comparative form further including a heat sink.

A radiator, so-called heat sink HS, for allowing heat generated in the reactor D1 to be radiated outside the reactor D1 may be further provided in the reactor D1 of the aforementioned embodiment. In this case, in order to maintain the insulation property of the insulating material used for insulating between the conductive member 10 wound around the air-core coil 1, the heat-transfer member conducting the heat of the air-core coil 1 to the core portion 2 is preferably provided between the air-core coil 1 and the core portion 2.

Figure 40B:
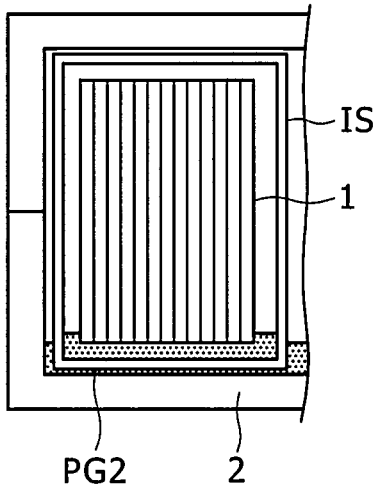
Figure 41A:
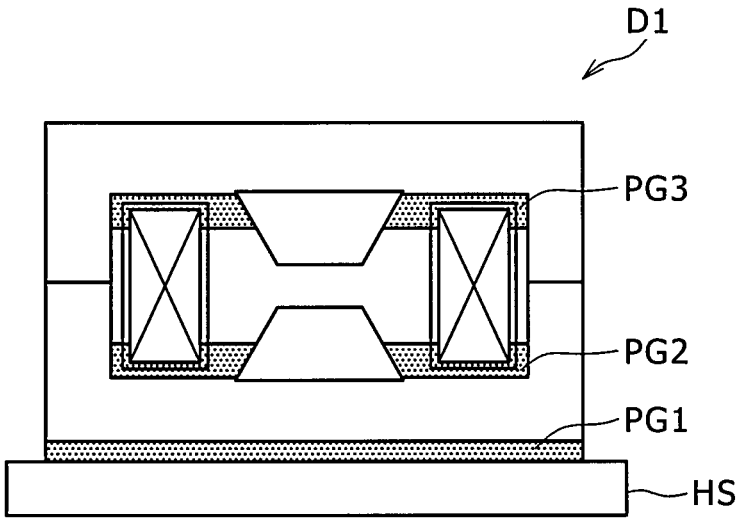
FIGS. 41(A) and (B) are illustrations showing a reactor of a second form further including a heat sink.
Figure 41B:
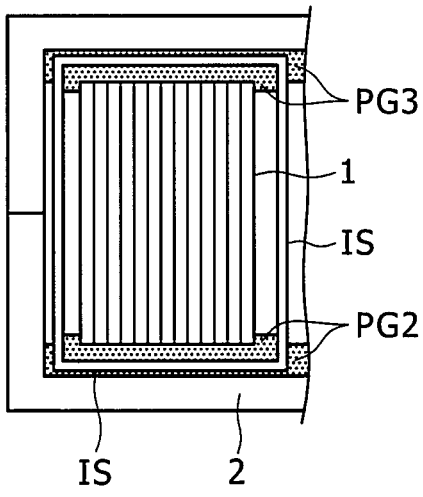
Figure 42A:
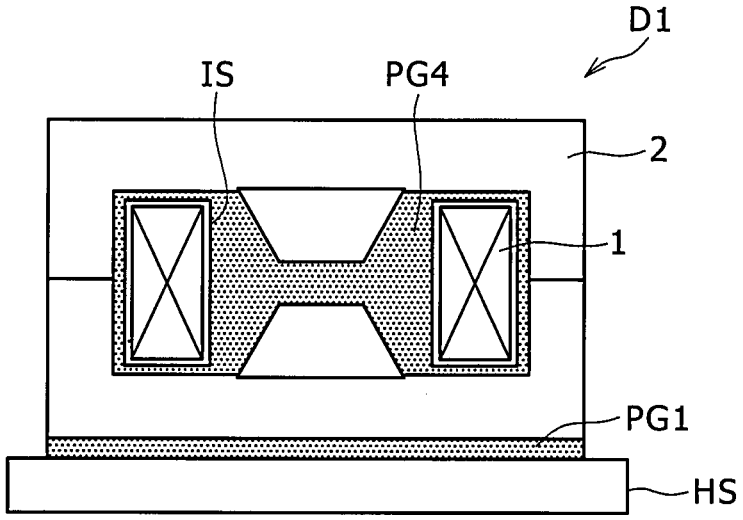
FIGS. 42(A) and (B) are illustrations showing the configuration of a reactor of a third form further including a heat sink.
Figure 42B:
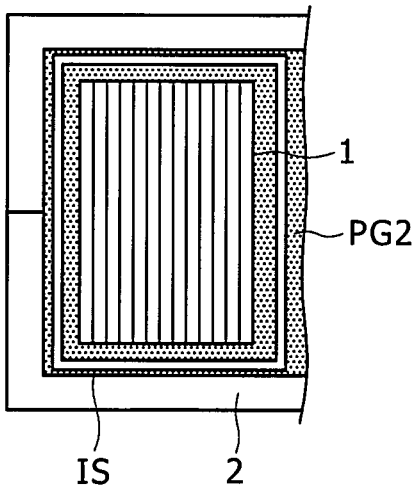
Figure 43:
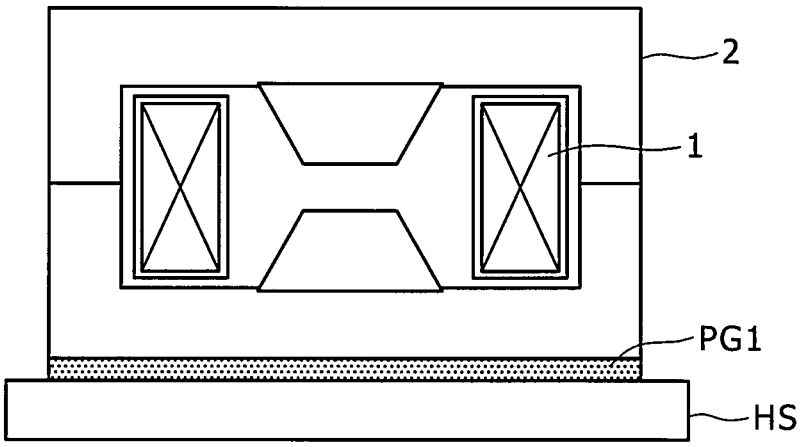
FIG. 43 is an illustration showing the configuration of a reactor of a comparative embodiment relative to the forms further including a heat sink shown in FIGS. 40 to 42.

As shown in FIGS. 40 to 42, the reactor D1 further including such a heat sink HS is fixed onto the heat sink HS via a heat-transfer member PG1. In addition, with the first form shown in FIGS. 40(A) and (B), for example, the reactor D1 further including the heat sink HS may further include a heat-transfer member PG2 between the one end of the air-core coil 1 and the one core portion surface facing this one end. Furthermore, with the second form shown in FIGS. 41(A) and (B), for example, a heat-transfer member PG3 may be further included between the other one end of the air-core coil 1 and the other one core portion side facing this other one end, as well as further including the heat-transfer member PG2 between the one end of the air-core coil 1 and the one core portion surface facing this one end. Moreover, with the third form shown in FIGS. 42(A) and (B), for example, a heat-transfer member PG4 may be further included over substantially the entire of the internal space of the core portion 2 (except for the portion of the coil 1). It should be noted that the reactor D1 shown in FIGS. 40 to 42 includes the aforementioned insulating member IS. The heat-transfer members PG (PG1 to PG4) are members for transmitting the heat of the air-core coil 1 to the core portion 2, and preferably is a material having a relatively high heat transfer coefficient. Furthermore, it is preferable for the air-core coil 1 and the core portion 2 to be adhered by the heat-transfer member PG. The heat-transfer member PG is a thermal grease or the like, for example.

With the reactor D1 further including the heat sink HS of such a configuration, heat generated in the air-core coil 1 of the reactor D1 is conducted to the heat sink HS via the core portion 2. Therefore, it is possible to efficiently radiate the heat from the heat sink HS, and the rise in the temperature of the reactor D1 can be reduced. Then, as shown in FIGS. 40 to 42, by further including the heat-transfer member PG between the air-core coil 1 and the core portion 2, the heat generated in the air-core coil 1 of the reactor D1 is more efficiently conducted to the heat sink HS via the core portion 2,7, whereby it is possible to radiate the heat from the heat sink HS. As a result, it becomes possible to prevent a decline (deterioration) in the insulation property of the insulating material used for insulating between the conductive member 10 wound in the air-core coil 1, and maintain the insulation property of the insulating material.

Herein, a resin material such as polyimide or PEN is used as the insulation between the conductive member 10 wound in the air-core coil 1 and insulating member IS. In the comparative form shown in FIG. 43, the heat sink HS is further provided; however, the heat-transfer member PG is not provided between the air-core coil 1 and the core portion 2. In such a case, the temperature of the reactor will exceed the temperature limit of these resins. However, in the cases shown in FIGS. 40 to 42 of the heat-transfer member PG being provided between the core portion 2 and each of the heat sink HS and air-core coil 1, the temperature of the reactor D1 is substantially steady-state (thermal equilibrium state) on the order of 140° C. at the most, which is no higher than the temperature limit of these resins. The thermal conductivity of the heat-transfer member PG is preferably at least 0.2 W/mK, and more preferably at least 1.0 W/mK. In addition, although the case of the reactor D1 has been explained in the foregoing, the case of the reactor D2 can be explained in a similarly way.

Figure 44A:
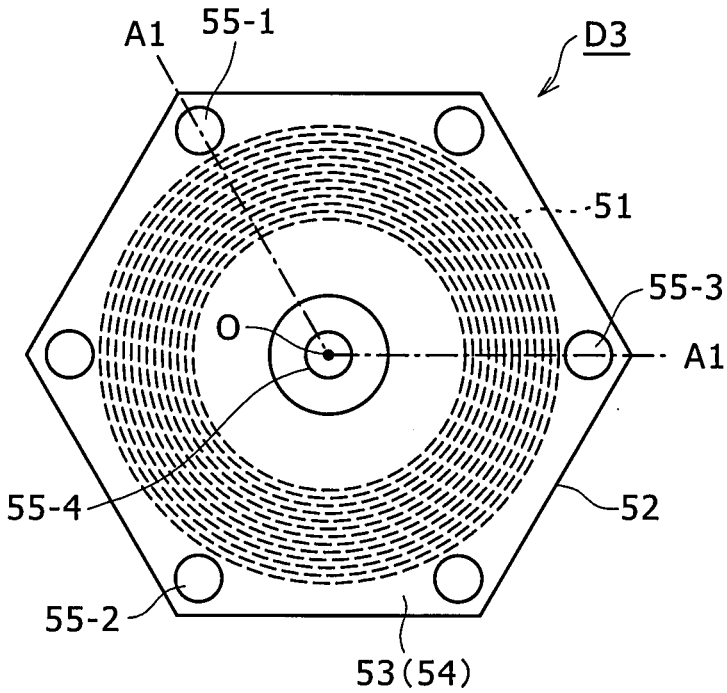
FIG. 44 is an illustration showing the configuration of a reactor further including fixing members and fastening members, with (A) being a top plan view and (B) being a cross-sectional view on the cutting-plane line A1 of (A)
Figure 44B:
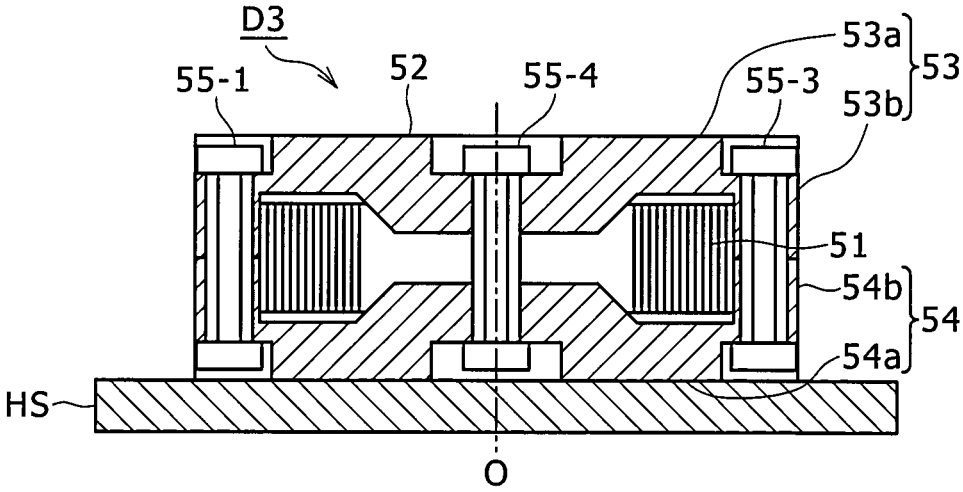
Figure 45A:
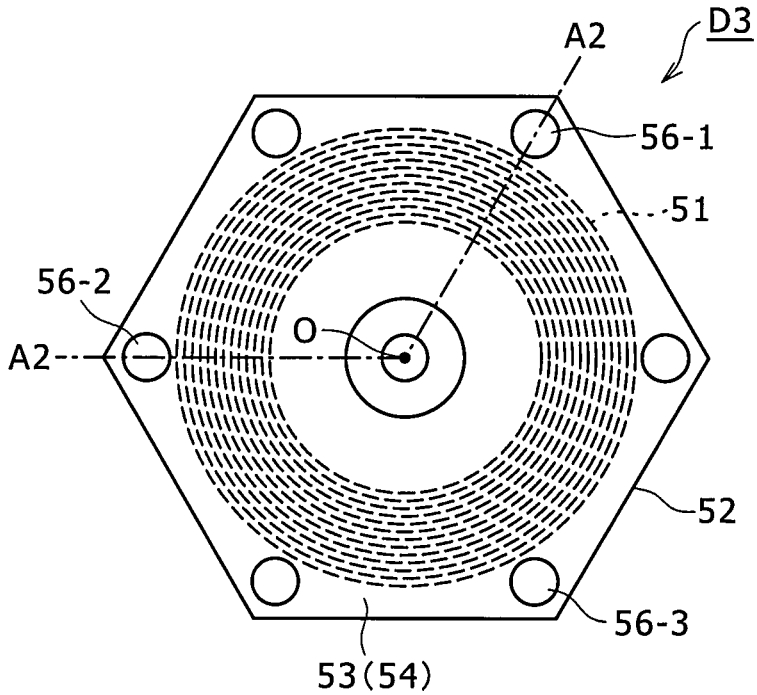
FIG. 45 is an illustration showing the configuration of a reactor further including fixing members and fastening members, with (A) being a top plan view and (B) being a cross-sectional view on the cutting-plane line A2 of (A)
Figure 45B:
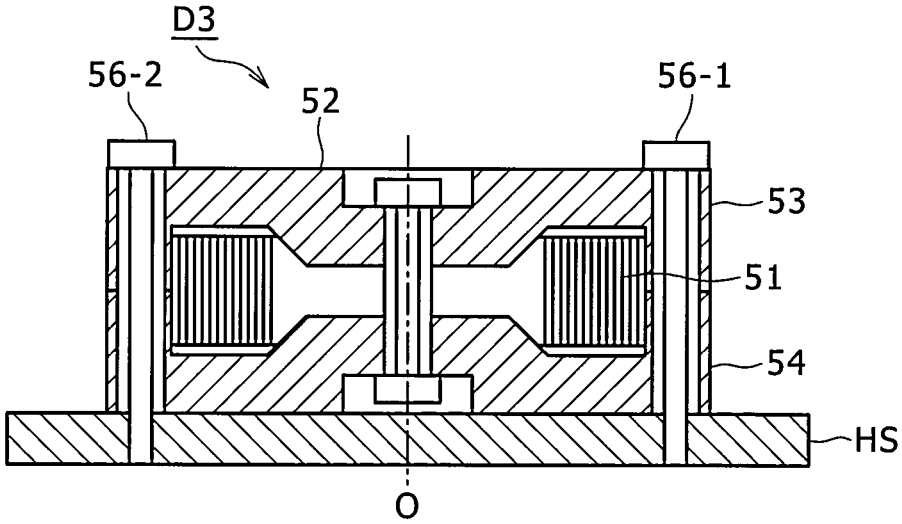

(9) FIGS. 44(A) and (B) and FIGS. 45(A) and (B) show the configuration of a reactor further including a fixing member and a fastening member. FIG. 44(A) and FIG. 45(A) show top plan views, FIG. 44(B) shows a cross-sectional view on the cutting-plane line A1 shown in FIG. 44(A), and FIG. 45(B) shows a cross-sectional view on the cutting-plane line A2 shown in FIG. 45(A). It should be noted that FIG. 44 and FIG. 45 show one reactor. It should be also noted that the mounting members are omitted from FIG. 44(A) and FIG. 45(A).

In the reactor of the aforementioned embodiment, the core portion is configured from a plurality of core members. Herein, the reactor further includes fixing members that fix the core member to mounting members for mounting the core portion, and fastening members that fasten a plurality of core members in order to form the core portion. The reactor may be configured so that first arrangement positions of the fixing members and second arrangement positions of the fastening members on the core portion are different from each other. With a reactor of such a configuration, since the arrangement positions of the fixing members and the arrangement positions of the fastening members are provided separately, after the core portion is formed by fastening the plurality of core members by the fastening members, the core portion can be fixed to the mounting member by the fixing members. As a result, the productivity of assembling and installing reactors can be improved.

Such a fixing member is a bolt, for example, and the fastening member is a bolt and nut, for example. The mounting member is a substrate, the aforementioned heat sink HS, the housing of a product using this reactor, or the like, for example.

The reactor further including such a fixing member and fastening member is the reactor D3, which is configured to include an air-core coil 51 having a flat-wise winding structure, and a core portion 52 covering the air-core coil 51, as shown in FIGS. 44(A) and (B), and FIGS. 45(A) and (B), for example.

Similarly to the core portion 2, the core portion 52 includes first and second core members 53 and 54, which have magnetic (e.g., magnetic permeability) isotropy together with having identical configurations. The first and second core members 53 and 54 are respectively configured so as to have tube parts 53*b* and 54*b* of a hexagonal shape in a cross section, having a periphery of the same dimension as the size of a hexagon formed by the six sides of hexagonal-plate parts 53*b* and 54*b* having a hexagonal shape, for example, continuous from the plate surface of the hexagonal-plate parts 53*a* and 54*a*. The core portion 52 is provided with a space for accommodating the air-core coil 51 inside by the first and second core members 53 and 54 being superimposed with each other along the end faces of the respective tube parts 53*b* and 54*b*.

Similarly to the air-core coil 1, an air-core part of columnar shape having a predetermined diameter at the center (on the axis-center O) is provided to the air-core coil 51. The air-core coil 51 is formed by a ribbon-shaped conductive member having a predetermined thickness being wound around a predetermined number of times in a state in which the width direction thereof is made to substantially match the axis-center direction, and is installed at the internal space of the core portion 52 (space formed by the inner wall faces of the first and second core members 53 and 54).

Then, through holes, formed along the axis-center O direction, and through which the fastening members 55 (55-1 to 55-3) and fixing members 56 (56-1 to 56-3) are inserted, are provided in each of the first and second core members 53 and 54 of this reactor D3. These through holes are formed at the interior side of the angles (inside of apex) of the hexagonal first and second core members 53 and 54, and the through holes for the fastening members 55 and the through holes for the fixing members 56 are alternately provided. In other words, since the first and second core members 53 and 54 are hexagonal in the example shown in FIGS. 44(A) and (B) and FIGS. 45(A) and (B), the angle formed between two adjacent through holes and the axis-center O is 60°. In addition, in this example, if focusing only on the through holes for the fastening members 55, the angle formed between two adjacent through holes for the fastening members 55 and the axis-center O is 120°. Furthermore, in this case, if focusing only on the through holes for the fixing members 56, the angle formed between two adjacent through holes for the fixing members 56 and the axis-center O is 120°. Since the through holes for the fastening members and the through holes for the fixing members are formed at different positions from each other in this way, the first arrangement positions of the fixing members 56 and the second arrangement positions of the fastening member 55 in the core portion 52 are different from each other. Furthermore, a through hole for the fastening member 55-4 is provided at a central position (position of axis-center O) of the first and second core members 53 and 54. In the reactor D3 of such a configuration, after causing the first and second core members 53 and 54 to abut each other, and inserting bolts of the fastening members 55 (55-1 to 55-4) into the through holes for the fastening members 55 provided in the first and second core members 53 and 54, the first and second core members 53 and 54 are tightened to each other by nuts and bolts.

It should be noted that, in a case of the aforementioned heat-transfer member PG being used and this heat-transfer member PG being a curable resin, it is preferable for the heat-transfer member PG to be hardened in this fastened state.

On the other hand, in the example shown in FIGS. 44(A) and (B) and FIGS. 45(A) and (B), a plurality of concave parts for anchoring the fixing members 56 (56-1 to 56-3) is formed in the heat sink HS, which is the mounting member. More specifically, a female thread is formed at the inner circumferential lateral surface of each concave part so as to be screwed to a male thread formed at one end of a bolt, which is the fixing member 56. Then, after inserting the bolts, which are the fixing members 56, into the through holes for fixing members 56 provided in the first and second core members 53 and 54, the bolts are screwed into the concave parts of the heat sink HS, and the reactor D3 is thereby fixed and mounted to the heat sink HS.

According to the reactor D3 of such a configuration, the productivity of assembling and mounting reactors can be improved, as described above. More specifically, for example, a method of tightly fixing with a clamp, or a method of tightly fixing with bolts and nuts will be considered as a method of fixing the first and second core members 53 and 54 as the core portion 52 while making them closely contacted with each other. In the case of tightly fixing with a clamp, since it is necessary to remove this clamp and fix the reactor to the mounting member, the productivity of assembly will decrease. In addition, in the case of tightly fixing with bolts and nuts, since the nuts fastened to the bolts for temporary assembly are removed from the bolts, and the reactor is fixed to the mounting member with the bolts, the productivity of mounting will decrease. On the other hand, with the aforementioned method of the present embodiment, since the first arrangement positions of the fixing members 56 and the second arrangement positions of the fastening members 55 are different from each other, fastening of the first and second core members 53 and 54 and fixing of the reactor D3 can be performed separately, and thus the productivity of assembly and mounting of the reactor D3 can be improved.

Furthermore, with the reactor D3 of such a configuration, the centers of the through holes for the fastening members 55, for example, form a triangle with the respective centers as the apexes, for example, an equilateral triangle. Since the first and second core members 53 and 54 are fastened by the fastening members 55 at these three points, stable fastening is possible. Then, the remaining through holes for the fixing members 56 similarly form a triangle, for example, an equilateral triangle. Since the core member 52 is fixed by the fixing members 56 to the mounting member (heat sink HS), stable fixing is possible.

Figure 46:
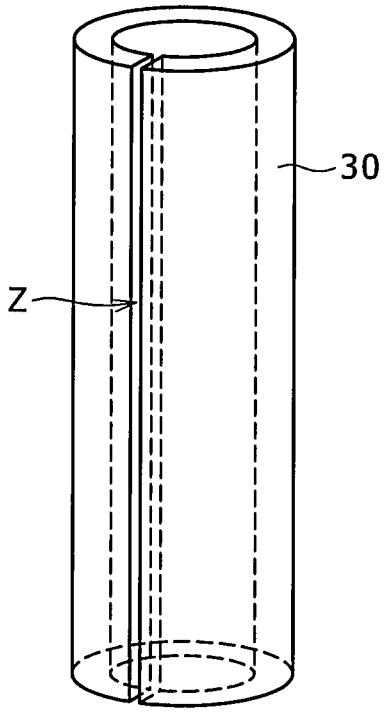
FIG. 46 is an illustration showing the form of a conductor in a case of installing a conductor of cylindrical shape or solid column shape to the air-core portion.
Figure 47A:
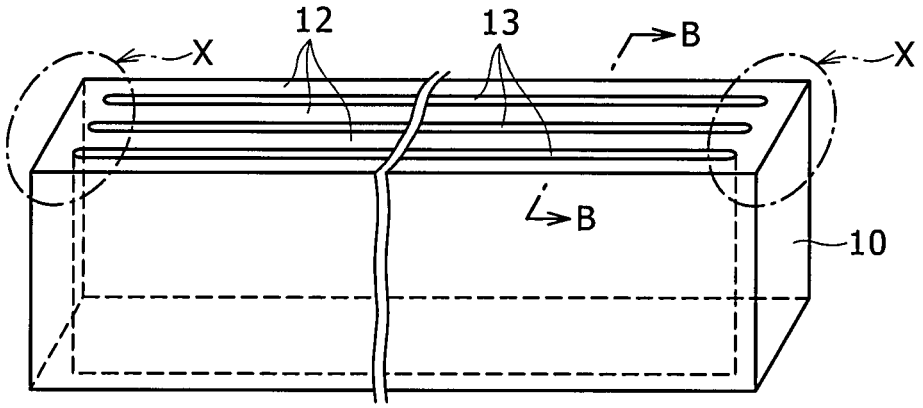
FIG. 47(*a*) is an external perspective view of a ribbon-shaped conductive member configuring an air-core coil, FIG. 47(*b*) is a cross-sectional view along the line B-B in FIG. 47(*a*), 47(*c*) is a view showing magnetic force lines (magnetic flux lines) of the air-core coil configured by the ribbon-shaped conductive member composed of a uniform material, and FIG. 47(*d*) is a view showing magnetic force lines (magnetic flux lines) of the air-core coil configured by a ribbon-shaped conductive member according to the present modified embodiment.
Figure 47B:
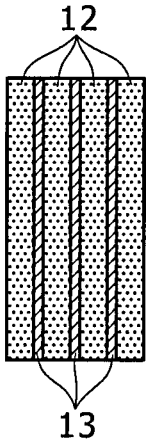
Figure 47C:
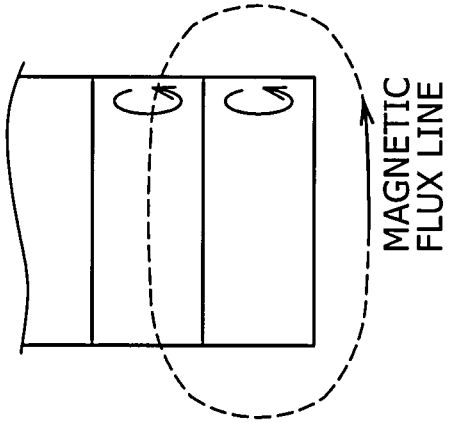
Figure 47D:
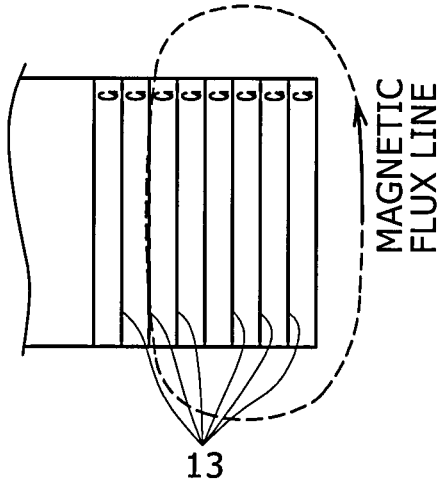

(8) FIG. 46 is an external perspective view of a conductor in a case of installing a conductor 30 of cylindrical shape or solid column shape to the air-core part S1. As shown in FIG. 46, in the case of installing the conductor 30 of cylindrical shape or solid column shape to the air-core part S1, when a slit Z extending along the axial direction is formed in the conductor 30, it can contribute to an increase in the inductance of the reactor D1.

(9) The core portion 2 may be configured by a ferrite core having magnetic isotropy. However, in the case of surrounding the air-core coil 1 by a magnetic body so that there is no magnetic flux leakage, magnetic flux lines must penetrate planes in a layered core such as magnetic steel sheets, and the eddy current loss occurring in the core portion 2 increases. Since the magnetic flux leakage can be suppressed with higher magnetic flux density and a reduction in size is possible, a pressurized powder core of iron-based soft magnetic powder is more preferable than soft ferrite.

(10) The air-core coil 1 may be configured by litz wire in which a plurality of thin insulated conductor wires are gathered and twisted.

(11) The ribbon-shaped conductive member 10 configuring the air-core coil 1 is not only composed of a uniform material but also may be made by layering conductive layers 12 and insulation layers 13 in the thickness direction thereof, as shown in FIGS. 47(*a*) and (*b*). FIG. 47(*a*) is an external perspective view of the ribbon-shaped conductive member 10 according to the present embodiment, and FIG. 47(*b*) is a cross-sectional view along the line B-B in FIG. 47(*a*).

In other words, in the case of the magnetic flux density being equal, the magnitude of the eddy current is proportional to the area of the continuous surface (series of surfaces) perpendicular to the magnetic force line (magnetic flux line). In the present embodiment, the surface of the conductive member 10 perpendicularly intersecting the magnetic force line (magnetic flux line) is partitioned by the insulation layer 13 configuring a discontinuous portion. According to such a configuration, compared to a case of the air-core coil 1 configured by the ribbon-shaped conductive member 10 composed of a uniform material (refer to FIG. 47(*c*)), it is possible to reduce the eddy current since the area of the continuous surface perpendicularly intersecting the magnetic force line (magnetic flux line) is reduced (refer to FIG. 47(*d*)).

It should be noted that, in order to make such composite (laminated) wires function as one conductor, it is necessary to join adjacent conductive layers 12 to each other, with an insulation layer 13 not being sandwiched between the layers 12, at locations which are outside of the core portion 2, and magnetic flux lines do not exist, such as ends, in the longitudinal direction, of the ribbon-shaped conductive member 10, shown in the portions X in FIG. 47(*a*). By establishing in this way, composite (laminated) wires can be made to function as one conductor, and the cross-sectional area of the conductor in a direction in which current flows is ensured, whereby an increase in the electrical resistance of the air-core coil 1 can be suppressed.

In addition, in the magnetic field, the direction in which the eddy current flows through the front surface of a wire, and the direction in which the eddy current flows through the back surface thereof are opposite to each other. According as the magnetic field decreases, the eddy current gradually returns inside of the conductor, and at a portion where the intersecting state of the magnetic field changes, it suddenly returns inside of the conductor. Thus, heat generation tends to become remarkable in the vicinity of the coil center, or in the vicinity of a pipe when the pipe is provided. According to the configuration in which ends, in the longitudinal direction, of the ribbon-shaped conductive member 10 are joined outside of the core portion 2, the return of eddy current can be made to occur at a location distant from the core portion 2, and thus it is possible to prevent heat generation inside of the air-core coil 1.

(12) In a case of using the ribbon-shaped conductive member 10 in which the conductive layers 12 and insulation layers 13 are layered in the thickness direction, conductive layers 12 themselves, or lead wires, which are led out from respective conductive layers 12, can pass through an inductor core 100, provided outside of the core portion 2, so as to be reverse phases from each other, and then be joined to each other. It is thereby possible to more effectively suppress eddy current.

Figure 48:
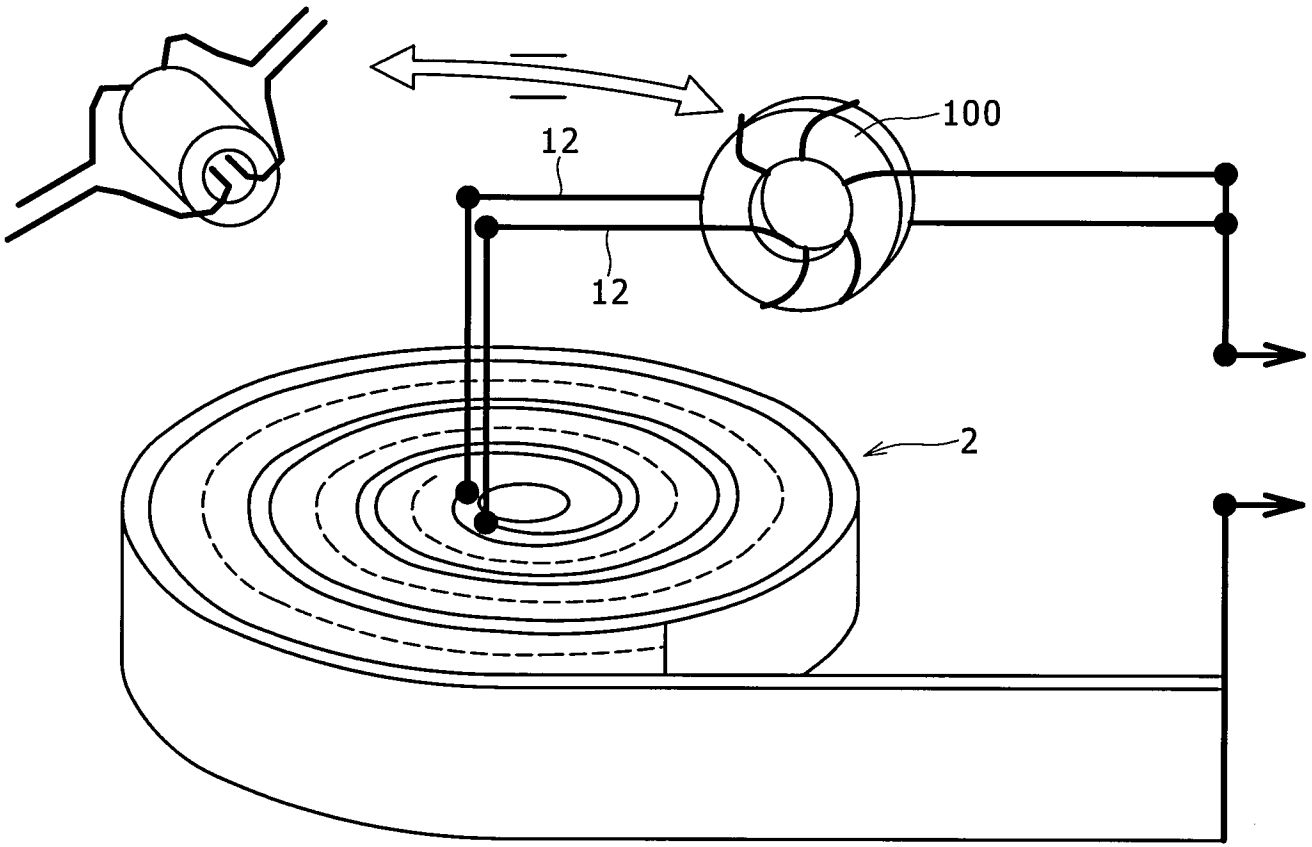
FIG. 48 is an illustration showing one example of a structure where an inductor core is provided outside of a core portion, and a conductor has two layers.

For example, as shown in FIG. 48, which is an example of a case in which the conductive layers 12 are two layers, the inductor core portion 100 is provided outside of the core portion 2, and the current flowing through each of the conductive layers 12 is made to go from one end of each of the conductive layers 12 through the inductor core portion 100 so as to be in reverse phase to each other. At this time, although the inductor core portion 100 acts as a large resistance only to the eddy current of opposite phase, and suppresses this current, it has no influence on the drive current flowing in the same phase. Therefore, it is possible to effectively reduce only the eddy current, whereby the overall loss is reduced. It should be noted that, although FIG. 48 is an example of a case of the conductive layers 12 being two layers, FIG. 49 is a schematic view showing a state of an external inductor core portion 100 in a case in which the conductive layers 12 are three layers, and FIG. 50 is a schematic view showing a state of the external inductor core portion 100 in a case in which the conductive layers 12 are four layers.

Figure 49:
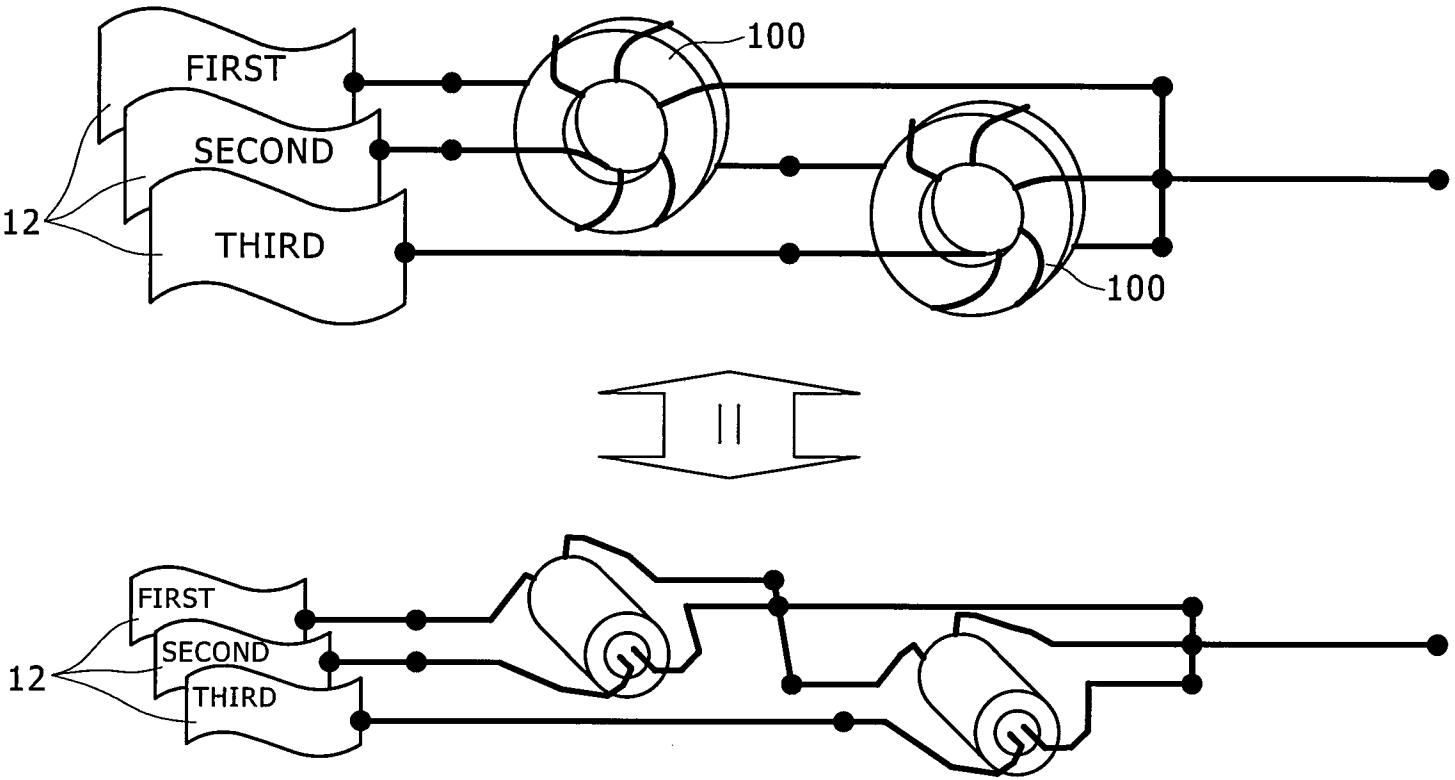
FIG. 49 is an illustration showing one example of a structure where an inductor core is provided outside of a core portion, and a conductor has three layers.

As shown in FIG. 49, in a case of the conductor layer 12 being three layers, two of the inductor core portions 100 are provided. The current flowing through a first conductive layer and a current flowing through a second conductive layer are established in reverse phases to each other by one inductor core portion 100. In addition, after the current flowing through a third conductive layer and the current flowing through the second conductive layer via the one inductor core portion 100 are established in reverse phases to each other by another inductor core portion 100, the currents flowing through each inductor core portion 100 are made to merge.

Figure 50:
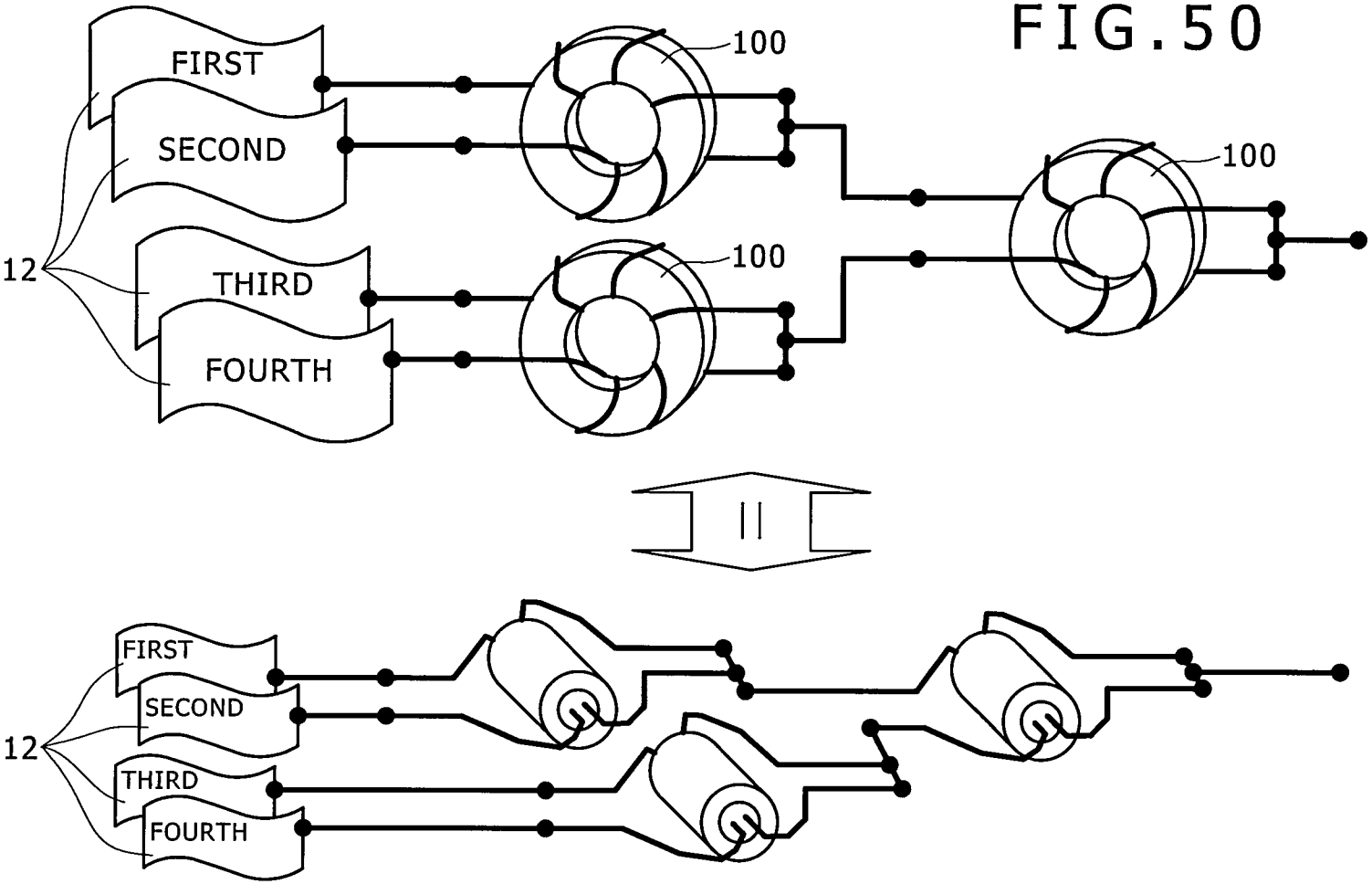
FIG. 50 is an illustration showing one example of a structure where an inductor core is provided outside of a core portion, and a conductor has four layers.

As shown in FIG. 50, in a case of the conductive layers 12 being four layers, three of the inductor core portions 100 are provided. After the current flowing through the first conductive layer and the current flowing through the second conductive layer are established in reverse phases to each other by a first inductor core portion 100, these currents are made to merge. Furthermore, after the current flowing through the third conductive layer and the current flowing through the fourth conductive layer are established in reverse phases to each other by a second inductor core portion 100, these currents are made to merge. Then, after the two currents formed by merging each are established as reverse phases to each other by a third inductor core portion 100, they are made to merge.

Here, the eddy current loss of a reactor such as that, in which the conductive layer 12 is a single layer of 0.6 mm in thickness, and the coil winding number is 32, of FIG. 1 was examined. In addition, the eddy current loss of a first multi-layer reactor of a configuration in which the conductive layers 12 are two layers of 0.3 mm in thickness, and the ends of conductive layers 12 are joined to each other outside of the core portion 2 was examined. Moreover, the eddy current loss of a second multi-layer reactor of a configuration in which the conductive layers 12 are two layers of 0.3 mm in thickness, and lead wires each led out from each conductive layer 12, respectively, go through the inductor cores provided outside of the core portion 2 so as to be reverse phases to each other, and then are joined was examined. More specifically, these were measured by resistance value when at 10 kHz, using an LCR meter.

As a result, the eddy current loss in the first multi-layer reactor could be reduced to about 56% of that in the case of a single layer (standard), and the eddy current loss in the second multi-layer reactor could be reduced to about 32% of that in the case of a single layer (standard).

(13) Generally, a reactor can be used as a voltage inverter and, for example, there is a three-phase voltage inverter disclosed in Japanese Patent Application Publication No. 2001-345224. This three-phase voltage inverter is of cable winding type. In this three-phase voltage inverter, a magnetic circuit is formed by an iron core yoke being provided to the top and bottom of three iron cores corresponding to the three phases of the U-phase, V-phase and W-phase. The conducting wires of the magnetic force lines are configured by such iron cores being joined together in the shape of an angular figure "8". A three-phase voltage inverter (reactor) of such a configuration is disposed in the middle of an electric power distribution system, and is useful for stabilizing voltage. In addition, due to recent progress in inverter technology, AC electric motors are more often arranged in factories, hybrid automobiles, electric automobiles, and the like in order to reduce the maintenance requirements. In such cases, although the three power lines of three-phase alternating current go from the inverter to an AC electric motor, for example, a three-phase voltage inverter (reactor) is usually connected in series between the inverter and the electric motor in order to improve the power factor.

The mainstream of the source of power in recent hybrid automobiles and the like has been synchronous AC motors equipped with permanent magnets. From the viewpoint of an improvement in ride quality, smoothness in the rotation is demanded for this electric motor. Synchronous AC electric motors of permanent magnet type, for example, are based on a combination (4-to-6) in which the number of magnetic poles on the rotor side is 4, and the number of magnetic poles on the stator side is 6. Realistically, a combination (8-to-12) in which the number of magnetic poles on the rotor side is 8 and the number of magnetic poles on the stator side is 12, or a combination (16-to-24) in which the number of magnetic poles on the rotor side is 16 and the number of magnetic poles on the stator side is 24 is used. Accompanying an increase in the pole number, the torque fluctuation, so-called cogging torque, is relieved, and oscillation occurrence is suppressed, which leads to an improvement in ride quality.

However, since the numbers of poles differ between the rotor and the stator as described in the foregoing, the excited coil inductance of the U-phase, V-phase and W-phase asymmetrically vary accompanying the rotation of the rotor. As a result, distortion arises in the three-phase AC voltage waveform applied from the inverter, and the waveform does not become the ideal sine waveform, and thus torque fluctuation occurs. Therefore, it is effective to insert a three-phase reactor between an in-car inverter and an electric motor installed in a hybrid automobile or the like, so as to absorb and mitigate the unwanted voltage waveform caused by nonlinear inductance, i.e. harmonic voltage component.

However, the aforementioned conventional three-phase voltage inverter has a relatively large physical size from the shape characteristic thereof, which is inconvenient upon equipped to an automobile having limited installation space.

Figure 51:
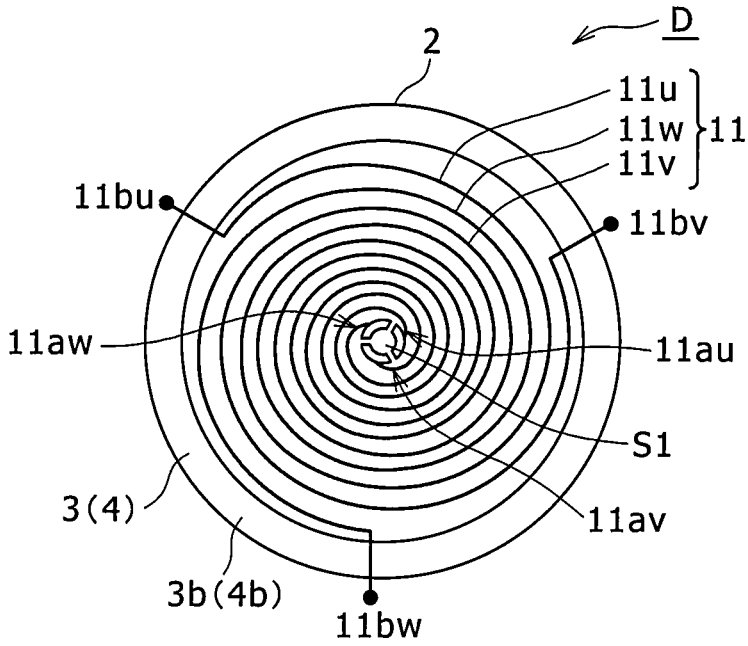
FIG. 51 is a cross-sectional view, cut from lateral side, showing a structure of a reactor where three layered single-phase coils are used for an air-core coil.

Therefore, as shown in FIG. 51, a three-layer air-core coil 11 is used that is formed by layering three single layer coils 11*u*, 11*v* and 11*w* in the thickness direction, each single layer coil being a base unit and formed by winding an elongated conductive member insulatively coated by an insulation material. Each winding start of these three single layer coils 11*u*, 11*v* and 11*w* is independent from each other as first terminals 11*au*, 11*av* and 11*aw* of current lines, respectively. In addition, each winding end of these three single layer coils 11*u*, 11*v* and 11*w* is independent from each other as second terminals 11*bu*, 11*bv* and 11*bw* of the current line.

In other words, the first single-layer coil flu among the three single layer coils is a coil for the U-phase of the three-phase alternating current, for example. The first single-layer coil flu is formed by winding the elongated conductive member, insulatively coated with a film-type electrical insulation layer, in a spiral manner from the center, and the winding ends at a predetermined inductance depending on the specification or the like, for example. The one end, which is the winding start, of the first single-layer coil 11*u* is the first terminal 11*au* of the current line, and is withdrawn to outside from a hole drilled in the axis-center of the core portion 2. The other end, which is the winding end, of the first single-layer coil flu is the second terminal 11*bu* of the current line, and is withdrawn to outside from a hole drilled in the cylindrical part 3*b* (4*b*) of the core portion 2.

The second single-layer coil 11*v* among the three single-layer coils is a coil for the V-phase of the three-phase alternating current, for example. The second single-layer coil 11*v* is formed by winding the elongated conductive member, insulatively coated with a film-type electrical insulation layer, in a spiral manner from the center, and the winding ends at a predetermined inductance depending on the specification or the like, for example. The one end, which is the winding start, of the second single-layer coil 11*v* is the first terminal 11*av* of the current line, and is withdrawn to outside from a hole drilled in the axis-center of the core portion 2. The other end, which is the winding end, of the second single-layer coil 11*v* is the second terminal 11*bv* of the current line, and is withdrawn to outside from a hole drilled in the cylindrical part 3*b* (4*b*) of the core portion 2.

Similarly, the third single-layer coil 11*w* among the three single-layer coils is a coil for the W-phase of the three-phase alternating current, for example. The third single-layer coil 11*w* is formed by winding the elongated conductive member, insulatively coated with a film-type electrical insulation layer, in a spiral manner from the center, and the winding ends at a predetermined inductance depending on the specification or the like, for example. The one end, which is the winding start, of the third single-layer coil 11*w* is the first terminal 11*aw* of the current line, and is withdrawn to outside from a hole drilled in the axis-center of the core portion 2. The other end, which is the winding end, of the third single-layer coil 11*w* is the second terminal 11*bw* of the current line, and is withdrawn to outside from a hole drilled in the cylindrical part 3*b* (4*b*) of the core portion 2.

Then, these three single-layer coils 11*u*, 11*v* and 11*w* are layered in the thickness direction while being electrically insulated by the electrical insulation film, and are fixed inside of the core portion 2 while they are closely contacted with each other. The cross section of the elongated conductive member is preferably a thin rectangular shape so as to facilitate lamination.

Although these three laminated single-layer coils 11*u*, 11*v* and 11*w* do no conduct due to being electrically insulated, they are magnetically mutually connected with each other by the proximity effect from layering, and form a magnetic circuit as in a conventional three-phase reactor.

By configuring the reactor D in this way, the coils for the three phases can be accommodated in the coil space for one; therefore, it is possible to make the physical size smaller compared to a conventional type of three-phase reactor of the same power capacity. The reactor D of such a configuration is particularly suited to the case of the reactor D equipped to mobile bodies (vehicles) such as electric automobiles, hybrid automobiles, trains and buses with limited installation space. In addition, in the power line from the inverter to the AC electric motor, the reactor D of such a configuration can absorb and smooth harmonic distortion voltage (so-called ripple) from the inverter, a result of which a waveform close to sine waveform can be output to the electric motor. This eliminates the output of harmonics to the electric motor and can suppress the occurrence of ripple voltage and surge voltage, and can prevent damage to equipment due to abnormal current flow. Thus, the voltage resistance of the inverter output terminal can be lowered, and thus it becomes possible to use cheaper components (elements). Furthermore, a backward flow of abnormal inverse voltage, caused by counter electromotive force generating in the AC electric motor, toward the inverter, is absorbed in the middle of the flow, which can also prevent damage to the inverter output terminal. In addition, since the coils for the three phases and the electrical insulation film are fixed so as to be closely connected with each other, the reactor D of such a configuration includes high rigidity as a structure, and can suppress shrinking oscillations of the magnetic force arising from the application of alternating current.

Figure 52:
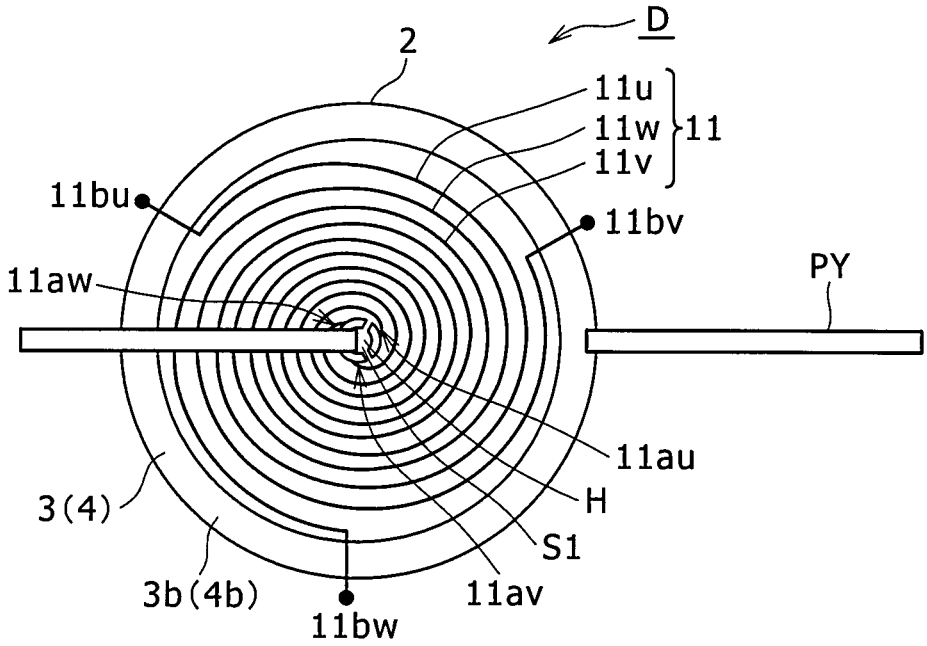
FIG. 52 is an illustration showing a configuration of a reactor including a cooling pipe.

Here, as shown in FIG. 52, in the reactor D of such a configuration (three-phase reactor), a hole H of substantially the same diameter of the air-core part S1 may be formed at a location, corresponding to the air-core part S1 of the three-layer air-core coil 11, in the core portion 2, and a cooling pipe PY penetrating the core portion 2 may be installed through this hole H. A fluid such as a gas such as air or a liquid such as water flows through the cooling pipe PY, for example. A central portion of the aforementioned three-layer air-core coil 11 is at the center of the core portion 2 in the configuration shown in FIG. 51; therefore, the current Joule heat from the passing of current may not easily be discharged but accumulated. By providing the cooling pipe PY, however, current Joule heat is conducted to outside by fluid flowing through the cooling pipe PY, and thus the heat can be discharged. It should be noted that, when the cooling pipe PY has electrical conductivity, an insulation material such as an electrical insulation film is used at parts, which may contact with the single-layer coils 11*u*, 11*v* and 11*w*, of the cooling pipe PY (for example, the winding starts of the single-layer coils 11*u*, 11*v* and 11*w*).

Although, in order to represent the present invention, the present invention has been appropriately and adequately explained through embodiments in the foregoing while referring to the drawings, it should be recognized that those skilled in the art can easily modify and/or improve the aforementioned embodiments. Therefore, unless a modified embodiment or improved embodiment carried out by those skilled in the art departs from the scope of the claims, the modified embodiment or improved embodiment should be construed as being included in the scope of the claims.

The present application is based on Japanese Patent Application (Application No. 2009-167789) filed on Jul. 16, 2009, Japanese Patent Application (Application No. 2009-211742) filed on Sep. 14, 2009, and Japanese Patent Application (Application No. 2010-110793) filed on May 13, 2010, and the contents thereof are incorporated herein by reference.

REFERENCE SIGNS LIST

1, 6 air-core coil
2, 7 core portion
3, 4, 8, 9 first, second core member
3*a*, 4*a*, 8*a*, 9*a* disc part
3*b*, 4*b*, 8*b*, 9*b* cylindrical part
3*c*, 4*c* convex part
3*d*, 4*d* concave part
20 to 22 core member
D1, D2 reactor
S1, S2 air-core part
Y concave groove
Z slit

The invention claimed is:

1. A reactor, comprising:

an air-core coil formed by winding an elongated conductive member; and a core portion that covers both ends and an outer circumference of said air-core coil, wherein a ratio t/W of a length t of said elongated conductive member in a radial direction of said air-core coil to a length W of said elongated conductive member in an axial direction of said air-core coil is no more than 1, wherein one surface of said core portion that opposes one end of said air-core coil and one other surface of said core portion that opposes one other end of said air-core coil are parallel at least in regions covering the coil ends, wherein a circumferential direction surface of said elongated conductive member forming said air-core coil is perpendicular relative to the one surface of said core portion, and wherein a ratio R/W of a radius R from a center to an outer circumference of said air-core coil to a length W of said elongated conductive member in the axial direction of said air-core coil is 2 to 4; and wherein projections protruding to said air-core coil are formed at positions, facing an air-core part of said air-core coil, on an upper face and a lower face of said core portion, said projections being formed so as to satisfy:

$$0<a\leq W/3 \text{ and } r>\sqrt{(A^2+(W/2)^2)}$$

wherein r is defined as the radius of said air-core part of said air-core coil, a is defined as the height from a core surface, opposing a coil end, of said projection, and A is defined as the radius of a projection bottom surface.

2. The reactor according to claim 1, wherein the ratio t/W is no more than 1/10.

3. The reactor according to claim 1, wherein the length t is no more than a skin thickness relative to a drive frequency of the reactor.

4. The reactor according to claim 1, wherein an absolute value of parallelism ((L1−L2)/L3), calculated by dividing a difference (L1−L2) between a space interval L1 between one surface of said core portion and one other surface of said core portion at an inner circumferential end of said air-core coil, and a space interval L2 between one surface of said core portion and one other surface of said core portion at an outer circumferential end of said air-core coil, by an average space interval L3 between one surface of said core portion and one other surface of said core portion from the inner circumferential end of said air-core coil to the outer circumferential end of said air-core coil, is no more than 1/50.

5. The reactor according to claim 1, wherein said elongated conductive member is formed by laminating conductive layers and insulation layers in a thickness direction thereof, and wherein said conductive layers that are adjoining each other are joined to each other outside of said core portion such that said insulation layers are not sandwiched at an end in the longitudinal direction of said elongated conductive member.

6. The reactor according to claim 5, wherein said conductive layers or lead wires led out from said respective conductive layers pass through an inductor core provided outside of said core portion so as to be reverse phases from each other, and then are joined to each other.

7. The reactor according to claim 1, wherein said air-core coil is formed by laminating three single-layer coils, each of which is formed by winding said elongated conductive member that is insulatively covered by an insulating material, in a thickness direction, and wherein winding starts of said three single-layer coils are independent from each other as first terminals of current lines, and winding ends of three of said single-layer coils are independent from each other as second terminals of said current lines.

8. The reactor according to claim 1, further comprising an insulation member that is disposed at least between one end of said air-core coil and one surface of said core portion opposing the one end, and between one other end of said air-core coil and one other surface of said core portion opposing the one other end.

9. The reactor according to claim 1, wherein said core portion includes a plurality of core members, wherein the reactor further comprises: a fixing member that fixes said core portion to a mounting member that mounts said core portion; and a fastening member that fastens said plurality of core members to form said core portion by said plurality of core members, and wherein a first arrangement position of said fixing member and a second arrangement position of said fastening member in said core portion are different from each other.

10. The reactor according to claim 1, wherein said core portion has magnetic isotropy and is formed by forming a soft magnetic powder.

11. The reactor according to claim 1, wherein said core portion is a ferrite core having magnetic isotropy.

* * * * *